US005970972A

United States Patent [19]

Suzuki et al.

[11] Patent Number: 5,970,972

[45] Date of Patent: Oct. 26, 1999

[54] VISCOUS FLUID TYPE HEAT GENERATOR WITH HEAT GENERATION REGULATING PERFORMANCE

[75] Inventors: Shigeru Suzuki; Takashi Ban; Tatsuya Hirose; Takahiro Moroi; Kiyoshi Yagi; Nobuaki Hoshino, all of Kariya, Japan

[73] Assignee: Kabushiki Kaisha Toyoda Jidoshokki Seisakusho, Aichi-ken, Japan

[21] Appl. No.: 08/898,157

[22] Filed: Jul. 22, 1997

[30] Foreign Application Priority Data

| | | | |
|---|---|---|---|
| Jul. 23, 1996 | [JP] | Japan | 8-193701 |
| Jul. 23, 1996 | [JP] | Japan | 8-193703 |
| May 13, 1997 | [JP] | Japan | 9-122302 |
| May 13, 1997 | [JP] | Japan | 9-122308 |

[51] Int. Cl.[6] ..... F24C 9/00

[52] U.S. Cl. ..... 126/247; 237/12.3; 237/12.3 B; 122/26; 123/142.5 R; 123/142

[58] Field of Search ..... 126/247; 237/12.3 R, 237/12.3 B; 122/26; 123/142.5 R, 142

[56] References Cited

U.S. PATENT DOCUMENTS

| | | | |
|---|---|---|---|
| 4,285,329 | 8/1981 | Moline . | |
| 4,387,701 | 6/1983 | Gibbons . | |
| 4,494,524 | 1/1985 | Wagner . | |
| 4,993,377 | 2/1991 | Itakura | 123/142.5 R |
| 5,279,262 | 1/1994 | Muehleck | 122/26 |
| 5,341,768 | 8/1994 | Pope . | |
| 5,419,306 | 5/1995 | Huffman . | |
| 5,704,320 | 1/1998 | Ban et al. | 122/26 |
| 5,727,510 | 3/1998 | Ban et al. | 123/142.5 R |
| 5,765,545 | 6/1998 | Ban | 126/247 |
| 5,771,712 | 3/1999 | Moroi | 126/247 |
| 5,788,151 | 8/1998 | Mori et al. | 237/12.3 R |
| 5,871,149 | 2/1999 | Moroi et al. | 237/12.3 R |
| 5,875,740 | 3/1999 | Ban et al. | 123/142.5 R |
| 5,875,741 | 3/1999 | Moroi et al. | 126/247 |
| 5,875,742 | 3/1999 | Moroi et al. | 122/26 |
| 5,878,951 | 3/1999 | Moroi et al. | 237/12.3 R |
| 5,881,682 | 3/1999 | Hirose et al. | 122/26 |
| 5,881,953 | 3/1999 | Moroi et al. | 237/12.3 R |

FOREIGN PATENT DOCUMENTS

| | | |
|---|---|---|
| 0073434 | 3/1983 | European Pat. Off. . |
| 0361053 | 4/1990 | European Pat. Off. . |
| 0610914 | 8/1994 | European Pat. Off. . |
| 2494782 | 5/1982 | France . |
| 9418815 | 7/1995 | Germany . |

*Primary Examiner*—Larry Jones
*Attorney, Agent, or Firm*—Morgan, Finnegan, L.L.P.

[57] ABSTRACT

A viscous fluid type heat generator including a housing assembly in which a heat generating chamber confining therein a heat generative viscous fluid to which a shearing action is applied by a rotor element rotated by a drive shaft, and having inner wall surfaces confronting outer surfaces of the rotor element, the inner wall surfaces of the heat generating chamber and the outer faces of the rotor elements defining a small space in which the heat generative viscous fluid is held, and having fluid movement regulator formed by an elongate recess or ridge formed therein to increase or suppress heat generation of the viscous fluid during the rotation of the rotor element in response to a change in an environmental condition in which the heat generator is used, and a change in an operation condition of the viscous fluid heat generator.

34 Claims, 13 Drawing Sheets

VISCOUS FLUID TYPE HEAT GENERATOR WITH HEAT GENERATION REGULATING PERFORMANCE

BACKGROUND OF THE INVENTION

1. Field of the Invention

The present invention relates generally to a viscous fluid type heat generator in which a viscous fluid is subjected to a shearing action to generate heat that is in turn transmitted to a circulating heat-transfer or heat-exchange fluid in a heat receiving chamber, and is carried by the heat-transfer fluid to a desired heated area, such as a passenger compartment in an automobile. More particularly, the present invention relates to a viscous fluid type heat generator adapted for being used as a supplementary heat source incorporated in an automobile heating system and having such a construction thereof able to regulate heat generation in response to either a change in an environment in which the viscous fluid type heat generator is used or a change in an operating condition of the heat generator, i.e., an operating speed of the viscous fluid type heat generator.

2. Description of the Related Art

Japanese Unexamined Patent Publication (Kokai) No. 2-246823 (JP-A-2-246823) discloses a typical automobile heating system in which a viscous fluid type heat generator, to generate heat by using a viscous fluid generating heat when it is subjected to shearing action, is incorporated. The viscous fluid type heat generator disclosed in JP-A-2-246823 includes a pair of mutually opposing front and rear housings tightly secured together by appropriate tightening elements, such as through bolts to define an inner heat generating chamber and a heat receiving chamber arranged adjacently to the heat generating chamber but separated by a partition wall through which the heat is exchanged between the viscous fluid in the heat generating chamber and the water in the heat receiving chamber. The heat exchanging water is introduced into the heat receiving chamber through a water inlet port and delivered from the heat receiving chamber toward an external heating system, and the water is constantly circulated through the heat generator and the external heating system.

A drive shaft is rotatably supported in the front housing via anti-friction bearing so as to support thereon a rotor element in such a manner that the rotor element is rotated with the drive shaft within the heat generating chamber. The rotor element has outer faces which are face-to-face with the inner wall faces of the heat generating chamber and form labyrinth grooves therebetween, and a viscous fluid is supplied into the heat generating chamber so as to fill the labyrinth grooves between the rotor element and the wall faces of the heating chamber.

When the drive shaft of the viscous fluid type heat generator incorporated in the automobile heating system is driven by an automobile engine, the rotor element is also rotated within the heat generating chamber so as to apply a shearing action to the viscous fluid held between the wall surfaces of the heat generating chamber and the outer surfaces of the rotor element. Thus, the viscous fluid which typically consists of a polymer material, typically a silicone oil having a chain molecular structure presenting a high viscosity, generates heat due to the shearing action applied thereto. The heat is transmitted from the viscous fluid to the heat exchanging water flowing through the heat receiving chamber. The heat exchanging water carries the heat to the heating circuit of the automobile heating system.

In the above-described viscous fluid type heat generator according to the prior art, when the rotor element is rotated about an axis of rotation thereof at a given rotating speed, a radially outer portion thereof far from the axis of rotation thereof has a circumferential speed larger than that of a radially inner portion of the rotor element located around the axis of rotation of the rotor element. Therefore, the outer portion of the rotor element can provide the viscous fluid within the heat generating chamber with a shearing action to generate heat which is more effective than that provided by the inner portion of the rotor element. Namely, the radially outer portion of the rotor element can make a contribution to the heat generation by the viscous fluid greater than the radially inner portion of the rotor element. Accordingly, if the viscous fluid type heat generator is used in either an environmental condition such that the atmospheric temperature is constantly low or an operating condition such that a large part of the operation of the viscous fluid type heat generator includes a low rotating speed operation of the drive shaft and the rotor element, a viscous fluid type heat generator is required to have a capability of forcibly moving the viscous fluid within the heat generating chamber from a region adjacent to the radially inner portion of the rotor element toward a different region adjacent to the radially outer portion thereof, so that a stronger shearing action can be applied to the viscous fluid.

Further, it should be understood that if the viscous fluid held to be in contact with the inner wall surfaces of the heat generating chamber and the outer surfaces of the rotor element is able to have a larger contacting area within the heat generating chamber, the viscous fluid can generate a greater amount of heat during the rotation of the rotor element.

When the rotor element of a viscous fluid type heat generator is constantly rotated at a high speed, the viscous fluid within the heat generating chamber is constantly subjected to a strong shearing action to thereby generate an excessive amount of heat, and as a result, the viscous fluid is thermally degraded after a relatively short operating life of the heat generator. Therefore, if the viscous fluid type heat generator is used in either an environmental condition such that the temperature is constantly warm or hot or an operating condition such that a large part of operation of the heat generator includes a high rotating speed operation of the drive shaft and the rotor element, the viscous fluid type heat generator is required to have a capability of forcibly moving the viscous fluid within the heat generating chamber from a region adjacent to the radially outer portion of the rotor element toward a separate region adjacent to the radially inner portion thereof.

Nevertheless, the viscous fluid type heat generators according to the prior art, e.g., the heat generator as disclosed in JP-A-2-246823, are not provided with any means to realize the above-mentioned two capabilities.

SUMMARY OF THE INVENTION

Therefore, an object of the present invention is to provide a viscous fluid type heat generator having a capability of generating an adjusted amount of heat in response to a change either in an environmental condition in which the heat generator is used or in an operating condition in which the heat generator is operated, i.e., an operating speed of the heat generator.

Another object of the present invention is to provide a viscous fluid type heat generator which is provided with internal means to forcibly move viscous fluid from a first specified region to a second specified region within a heat generating chamber.

A further object of the present invention is to provide a viscous fluid type heat generator provided with a means for increasing or strengthening a shearing action applied to a viscous fluid confined within a heat generating chamber of the heat generator whereby an amount of heat generation by the viscous fluid confined within a heat generating chamber may be increased.

A still further object of the present invention is to provide a viscous fluid type heat generator capable of increasing an amount of heat generation causing an increase in neither the manufacturing cost of the heat generator nor the entire physical size of the heat generator.

In accordance with one aspect of the present invention, there is provided a viscous fluid type heat generator which includes a housing assembly defining therein a heat generating chamber in which heat is generated, and a heat receiving chamber arranged adjacent to the heat generating chamber for permitting a heat exchanging fluid to circulate therethrough to thereby receive heat from the heat generating chamber, the heat generating chamber having inner wall surfaces thereof;

a drive shaft supported by the housing assembly to be rotatable about an axis of rotation thereof in a predetermined direction, the drive shaft being operationally connected to an external rotation-drive source;

a rotor element mounted to be rotationally driven by the drive shaft for rotation together therewith in the predetermined rotating direction within the heat generating chamber, the rotor element having outer faces confronting the inner wall surfaces of the heat generating chamber via a predetermined amount of space;

a viscous fluid, filling the space between the inner wall surfaces of the heat generating chamber of the housing assembly and the outer faces of the rotor element, for heat generation by the rotation of the rotor element; and, fluid movement regulating means arranged in the heat generating chamber to provide the viscous fluid with a regulated movement thereof from a first specified region toward a second specified region within the heat generating chamber when the rotor element is rotated by the drive shaft relative to the inner wall surfaces of the heat generating chamber.

When the first and second specified regions are radially inner and outer regions within the heat generating chamber, respectively, with respect to the axis of rotation of the rotor element, the fluid movement regulating means can provide the viscous fluid with a regulated movement thereof directing toward the outer region extending around a radially outer portion of the rotor element during the rotation of the rotor element. Thus, since the radially outer portion of the rotor element has a circumferential speed larger than that of a radially inner portion of the rotor element, a large shearing action is applied to the viscous fluid by the rotor element and the inner wall surfaces of the heat generating chamber so as to enhance heat generation by the viscous fluid.

When the first and second specified regions are radially outer and inner regions within the heat generating chamber, respectively, with respect to the axis of rotation of the rotor element, the fluid movement regulating means may provide the viscous fluid with a regulated movement from the radially outer region toward the inner region extending around the radially inner portion of the rotor element during the rotation of the rotor element. Thus, since the radially inner portion of the rotor element has a circumferential speed smaller than that of the radially outer portion of the rotor element, a less strong shearing action is applied to the viscous fluid by the rotor element and the inner wall surfaces of the heat generating chamber so as to suppress heat generation by the viscous fluid.

The fluid movement regulating means may be a fluid outward supply means for urging the viscous fluid held in the radially inner region of the heat generating chamber to be supplied into and collected in the radially outer region of the heat generating chamber where the viscous fluid can be subjected to a strong shearing action by the radially outer portion of the rotor element. Then, the amount of heat generation by the viscous fluid can be effectively increased during the rotation of the rotor element.

Preferably, the fluid outward supply means may comprise at least one of a ridge and an elongate recess formed in at least one of opposite outer circular end faces of the rotor element in such a manner that each of the ridge and the elongate recess is arranged to be angularly shifted or curved with respect to a radial line of the rotor element in a direction reverse to the predetermined rotating direction of the rotor element.

The ridge or the elongate recess of the rotor element can act so as to urge the viscous fluid to move from the inner region toward the outer region of the heat generating chamber due to the rotation of the rotor element in the predetermined rotating direction. Thus, a strong shearing action is applied to the viscous fluid by the radially outer portion of the rotating rotor element, and accordingly, the amount of generation of heat by the viscous fluid can be effectively increased.

At this stage, when the viscous fluid is urged by the ridge or the elongate recess of the rotor element to move from the inner region toward the outer region of the heat generating chamber, a fluid pressure prevailing in the outer region gradually becomes higher than that prevailing in the inner region. Accordingly, in response to an increase in the fluid pressure in the outer region, the viscous fluid is urged to move back from the outer region toward the inner region of the heat generating chamber through an appropriate passage spaced from the ridge or the elongate recess. Therefore, the viscous fluid repeatedly moves from the inner to outer regions and vice versa within the heat generating chamber during the operation of the heat generator. This movement of the viscous fluid causes mixing of the fluid in both inner and outer regions within the heat generating chamber so that the viscous fluid can be prevented from having an excessively high temperature during the heat generating operation of the heat generator. Thus, the viscous fluid can be prevented from being thermally degraded for a long operation life of the viscous fluid type heat generator.

When the fluid outward supply means comprises the elongate recess, a gaseous mixture or air bubbles in the viscous fluid is fluid-dynamically trapped by the elongate recess during the rotation of the rotor element. Therefore, the viscous fluid from which the gaseous mixture is removed is held between the space between the outer faces of the rotor element and the inner wall surfaces of the heat generating chamber except for the elongate recess. Thus, the shearing action applied to the viscous fluid from which the gaseous mixture is removed can be very effective for the viscous fluid to frictionally generate heat and, an amount of generation of heat by the viscous fluid can be appreciably increased.

Preferably, the ridge or the elongate recess formed in at least one of the opposite outer circular end faces of the rotor element should have an end thereof terminating at a position adjacent to an outer peripheral portion of the rotor element.

Alternatively, the fluid outward supply means may comprise at least one of a ridge and an elongate recess formed in at least one of front and rear inner circular wall surfaces of the heat generating chamber selected from the entire inner wall surfaces thereof, the ridge and the elongate recess of the front or rear inner circular wall surface of the heat generating chamber being formed in such a manner that each of the ridge and the elongate recess is arranged to be angularly shifted or curved with respect to a radial line of the inner circular wall surface of the heat generating chamber in the direction the same as the predetermined rotating direction of the rotor element. The ridge or the elongate recess can act so as to urge the viscous fluid to be supplied from the radially inner region toward the radially outer region of the heat generating chamber in response to the rotation of the rotor element. Thus, a stronger shearing action is applied to the viscous fluid by the radially outer portion of the rotating rotor element, and accordingly, the amount of generation of heat by the viscous fluid can be increased.

When the viscous fluid is urged by the above-mentioned ridge or the elongate recess formed in the inner circular wall surface or surfaces of the heat generating chamber to move from the inner region toward the outer region of the heat generating chamber, a fluid pressure prevailing in the outer region of the heat generating chamber gradually becomes higher than that prevailing in the inner region. Accordingly, in response to an increase in the fluid pressure in the outer region, the viscous fluid is urged to move back from the outer region toward the inner region of the heat generating chamber through an appropriate passage spaced from the ridge or the elongate recess. Therefore, the viscous fluid repeats movement from the inner to outer regions and vice versa within the heat generating chamber during the operation of the heat generator. This movement of the viscous fluid causes mixing of the fluid in both inner and outer regions in the heat generating chamber so that the viscous fluid can be prevented from having an excessively high temperature during the heat generating operation of the heat generator. Thus, the viscous fluid can be prevented from being thermally degraded for a long operation life of the viscous fluid type heat generator.

Further, it should be understood that the above-mentioned ridge or the elongate recess formed in at least one of the inner circular wall surfaces of the heat generating chamber can function to increase heat transmission from the viscous fluid within the heat generating chamber to the heat exchanging liquid flowing through the heat receiving chamber.

The ridge or the elongate recess formed in at least one of the inner circular wall surfaces of the heat generating chamber may have the shape of either a spirally extending ridge or a spirally extending recess.

Preferably, the elongate recess formed in one of the inner circular wall surfaces of the heat generating chamber has a portion thereof which is located adjacent to a radially outer peripheral portion of the inner circular wall of the heat generating chamber and provided with a sloping bottom portion thereof formed such that the depth of the sloping bottom portion becomes gradually shallower from a radially inner side thereof to a radially outer side thereof.

Alternatively, the fluid movement regulating means may be a fluid inward supply means for urging the viscous fluid held in the radially outer region of the heat generating chamber to be supplied into and collected in the radially inner region of the heat generating chamber where the viscous fluid can be subjected to a less strong shearing action by the radially inner portion of the rotor element. Then, the heat generation by the viscous fluid can be effectively suppressed. Namely, an excessive amount of generation of heat by the viscous fluid can be prevented.

Therefore, the viscous fluid heat generator provided with the above-mentioned fluid inward supply means may be effectively incorporated in a heating system particularly used in either an warm and hot environmental condition or in an operating condition such that a large part of operation of the heat generator includes a high rotating speed operation of the drive shaft and the rotor element.

When the viscous fluid held in the radially outer region of the heat generating chamber is supplied by the fluid inward supply means into the radially inward region of the heat generating chamber, a fluid pressure prevailing in the inner region gradually becomes higher than that prevailing in the inner region. Accordingly, in response to an increase in the fluid pressure in the inner region, the viscous fluid is urged to move back from the inner region toward the outer region of the heat generating chamber through an appropriate passage spaced away from the fluid inward supply means. Therefore, the viscous fluid repeats movement from the outer to inner regions and vice versa within the heat generating chamber during the operation of the heat generator. This movement of the viscous fluid causes mixing of the fluid in both inner and outer regions within the heat generating chamber so that the viscous fluid can be prevented from having an excessively high temperature during the heat generating operation of the heat generator. Thus, the viscous fluid can be prevented from being thermally degraded for a long operation life of the viscous fluid type heat generator.

Preferably, the fluid inward supply means may comprise at least one of a ridge and an elongate recess formed in at least one of opposite outer circular end faces of the rotor element in such a manner that each of the ridge and elongate recess is arranged to be angularly shifted or curved with respect to a radial line of the outer circular end face of the rotor element in a direction the same as the predetermined rotating direction of the rotor element.

The above ridge or the elongate recess of the rotor element can act so as to urge the viscous fluid to move from the outer region toward the inner region of the heat generating chamber due to the rotation of the rotor element in the predetermined rotating direction. Thus, the viscous fluid held in the outer region of the heat generating chamber can be effectively supplied into the radially inner region of the heat generating chamber by the radially outer portion of the rotating rotor element, and accordingly, the amount of generation of heat by the viscous fluid can be effectively increased.

Alternatively, the fluid inward supply means may comprise at least one of a ridge and an elongate recess formed in at least one of front and rear inner circular walls of the heat generating chamber selected from the inner wall surfaces thereof, the ridge and the elongate recess of the front or rear inner circular wall surface of the heat generating chamber being formed in such a manner that each of the ridge and the elongate recess is arranged to be angularly shifted or curved with respect to a radial line of the inner circular wall surface of the heat generating chamber in the direction reverse to the predetermined rotating direction of the rotor element.

Preferably, the housing assembly may further defines a fluid storing chamber which fluidly communicates with the heat generating chamber by a fluid supplying passageway and a fluid withdrawing passageway, and has a capacity thereof sufficient for storing a given volume of viscous fluid which is larger than the capacity of the space between the inner wall surfaces of the heat generating chamber and the outer faces of the rotor element.

In accordance with another aspect of the present invention, there is provided a viscous fluid type heat generator which includes a housing assembly defining therein a heat generating chamber in which heat is generated and a heat receiving chamber arranged adjacent to the heat generating chamber for permitting a heat exchanging fluid to circulate therethrough to thereby receive heat from the heat generating chamber, the heat generating chamber having inner wall surfaces thereof;

a drive shaft supported by the housing assembly to be rotatable about an axis of rotation thereof in a predetermined direction, the drive shaft being operationally connected to an external rotation-drive source;

a rotor element mounted to be rotationally driven by the drive shaft for rotation together therewith in the predetermined rotating direction within the heat generating chamber, the rotor element having outer faces confronting the inner wall surfaces of the heat generating chamber via a predetermined amount of space;

a viscous fluid, filling the space between the inner wall surfaces of the heat generating chamber of the housing assembly and the outer faces of the rotor element, for heat generation by the rotation of the rotor element; and, fluid shearing energizing means arranged in the heat generating chamber to strengthen a shearing action applied to the viscous fluid held in the space between the inner wall surfaces of the heat generating chamber of the housing assembly and the outer faces of the rotor element when the rotor element is rotated by the drive shaft relative to the inner wall faces of the heat generating chamber whereby an amount of generation of heat is increased during the rotation of the rotor element.

Preferably, the fluid shearing energizing means comprises one of a ridge and an elongate recess formed in at least one of the outer faces of the rotor element and the inner wall surfaces of the heat generating chamber, the ridge or the elongate recess being arranged to change an extent of the space in a circumferential direction with respect to the axis of rotation of the rotor element whereby the viscous fluid having a chain molecular structure is subjected to a restraint against movement of the viscous fluid in a circumferential direction caused by the rotation of the rotor element. Thus, the viscous fluid is subjected to a stronger shearing action and generates a larger amount of heat.

BRIEF DESCRIPTION OF THE DRAWINGS

The above and other objects, features and advantages of the present invention will be made apparent from the ensuing description of preferred embodiments thereof with reference to the accompanying drawings wherein.

DESCRIPTION OF THE PREFERRED EMBODIMENTS

FIGS. 1 through 5 illustrate a viscous fluid type heat generator of a first embodiment of the present invention.

Figure 1:
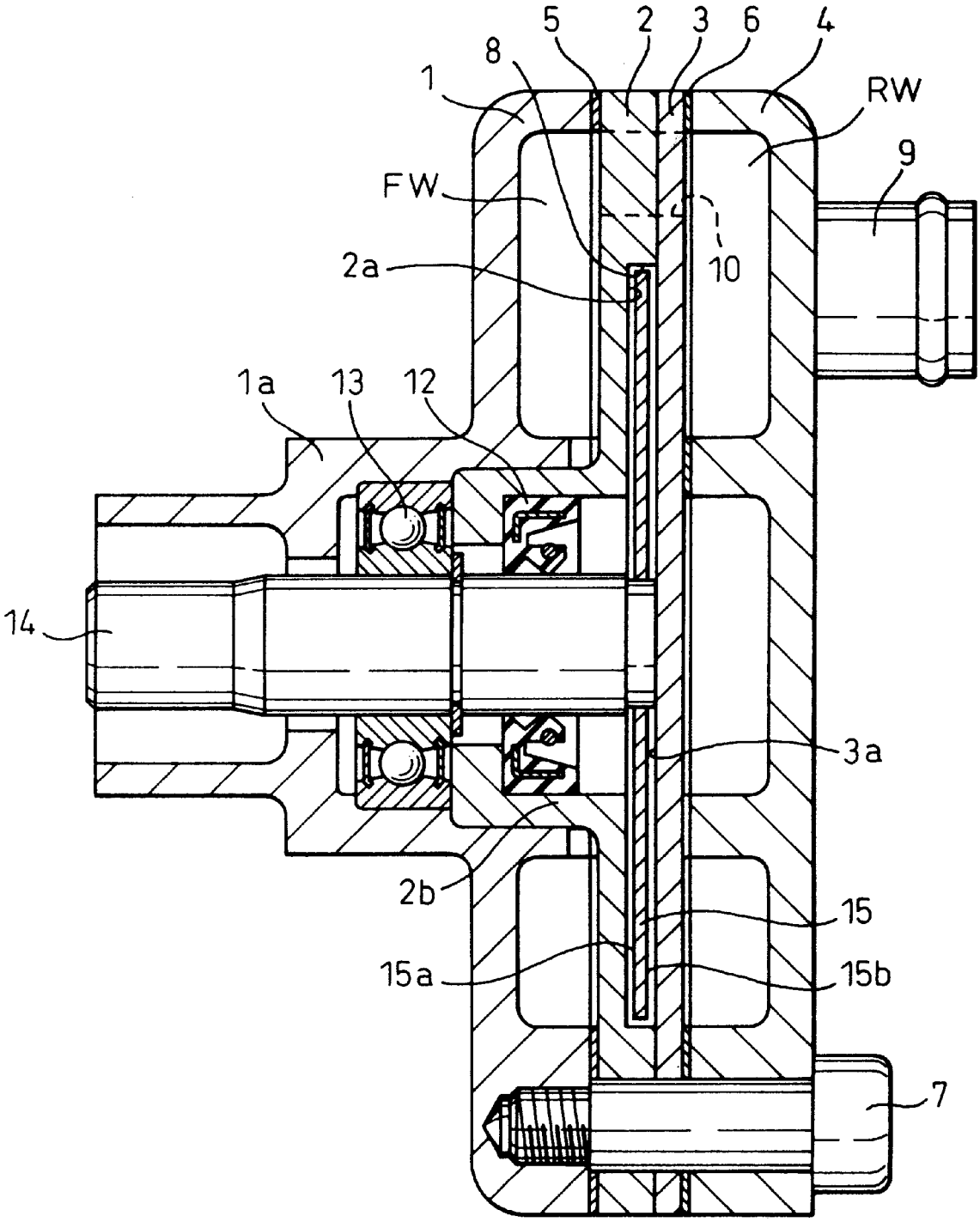
FIG. 1 is a longitudinal cross-sectional view of a viscous fluid type heat generator according to a first embodiment of the present invention.

Referring to FIG. 1, the viscous fluid type heat generator which is constructed as a viscous fluid type heat generator having a heat generation adjusting performance, includes a housing assembly including a front housing body 1, a front plate element 2, a rear plate element 3, and a rear housing body 4 which are arranged in a juxtaposition and combined together by a plurality of screw bolts 7. Gasket elements 5 and 6 are interposed between the front housing body 1 and the front plate 2, and the rear plate element 3 and the rear housing body 4, to hermetically seal the connecting portions. The housing assembly has a front housing portion formed by the front housing body 1 and the front plate element 2, and a rear housing portion formed by the rear plate element 3 and the rear housing body 4. The front plate element 2 has opposite front and rear faces, and the rear face is provided with a circular recess formed therein to have a flat circular end face 2*a* cooperating with a flat circular front end face 3*a* of the rear plate element 3 in defining a cylindrical heat generating chamber 8.

The front housing body 1 is provided with an inner annular recess, formed in an inner face thereof, and cooperating with the front face of the front plate element 2 to define a front heat receiving chamber FW arranged adjacent to the front side of the heat generating chamber 8.

The rear housing body 4 is internally provided with radially inner and outer ribs extending annularly and projecting axially toward the gasket 6 so as to be tightly engaged with the gasket 6. A portion of the inner face of the rear housing body 4 located radially outside the inner rib and a portion of the rear end face of the rear plate element 3 defines a rear heat receiving chamber RW which is arranged adjacent to the rear side of the heat generating chamber 8.

The rear housing body 4 is provided with a rear end face having an inlet port 9 and an outlet port (not shown) arranged at an outer peripheral portion of the rear end face. The inlet port 9 is provided for introducing heat exchanging liquid into the front and rear heat receiving chambers FW and RW, and the outlet port is provided for delivering the heat exchanging liquid from the heat receiving chambers FW and RW toward the external heating system are defined. The outlet port is arranged circumferentially adjacent to the inlet port 9.

A plurality of equiangularly arranged passageways 10 are formed in outer peripheral portions of the front and rear plate elements 2 and 3, so as to provide a fluid communication between the front and rear heat receiving chambers FW and RW. Two neighboring passageways 10 are arranged circumferentially on both sides of one of the bolts 7 axially tightly combining the front housing body 1, the front plate element 2, the rear plate element 3 and the rear housing body 4 of the housing assembly.

The front plate element 2 is provided with a boss 2*b* at a central portion thereof for housing a shaft sealing device 12 therein. The shaft sealing device 12 is arranged adjacent to the heat generating chamber 8.

Figure 2:
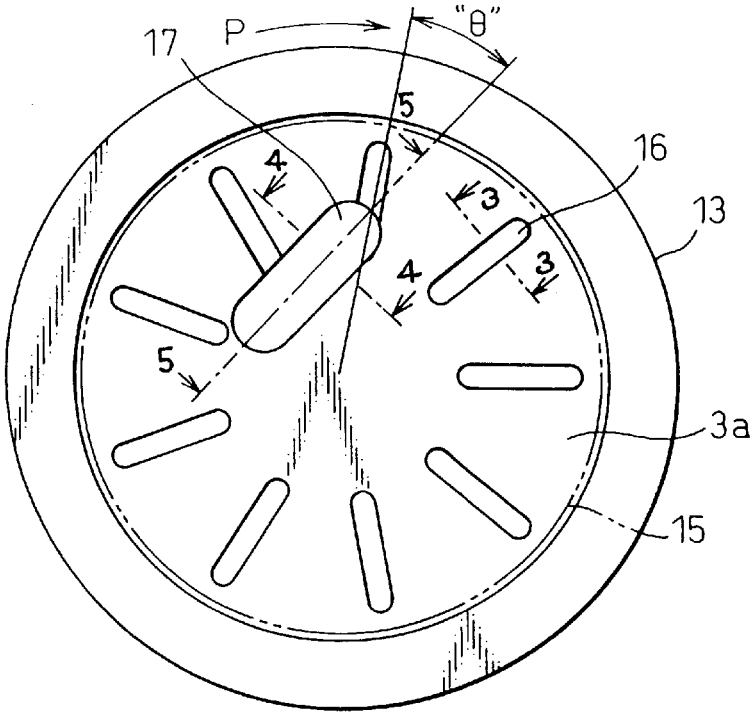
FIG. 2 is an end view of a rear plate element incorporated in the viscous fluid type heat generator of the first embodiment of the present invention.

The front housing body 1 is provided with an axially outwardly projecting boss portion 1*a* which houses a front bearing device 13 supporting a central portion of a drive shaft 14. Namely, the drive shaft 14 typically arranged in a substantially horizontal state is supported by the bearing devices 13 and by the shaft sealing device 12 to be rotatable about an axis of rotation extending horizontally. A rotor element 15 in the shape of a flat disc is mounted and tightly fitted on an axial rear end of the drive shaft 14, and arranged to be rotated by the drive shaft 14 about an axis of rotation thereof within the heat generating chamber 8. The rotor element 15 has axially opposite circular faces 15*a* and 15*b*, and a circumference which form the outer faces of the rotor element 15. The circular faces 15*a* and 15*b* are formed to have a radius far larger than the dimension of the thickness of the rotor element 15, as shown in FIG. 2. The outer diameter of the rotor element 15 is slightly smaller than the inner diameter of the cylindrical heat generating chamber 8 so that a small gap is provided between the circumference of the rotor element 15 and a circular inner wall surface of the heat generating chamber 8.

Within the heat generating chamber 8, the opposite circular faces 15*a* and 15*b* of the rotor element 15, i.e., the front and rear faces of the rotor element 15 confront corresponding inner circular wall surfaces of the heat generating chamber 8, i.e., the flat end faces 2*a* and 3*a* of the front and rear plate elements 2 and 3 via each small axial space at an extent of e.g., 0.2 mm or 0.25 mm.

A space between the outer faces of the rotor element 15 and the inner wall surfaces of the heat generating chamber including the space between the front and rear faces 15*a* and 15*b* of the rotor element 15 and the corresponding circular end faces 2*a* and 3*a* of the front and rear plate elements 2 and 3 is filled with silicone oil which is a typical viscous fluid having chain molecular structure therein to exhibit a large viscosity.

The drive shaft 14 has an outermost end on which either a pulley (not shown) or a solenoid clutch (not shown) is mounted to operatively connected the heat generator to an outer rotational drive source, typically an automobile engine, via a suitable belt.

Figure 3:
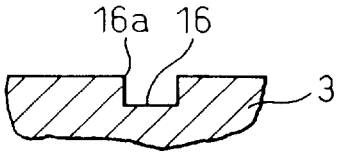
FIG. 3 is a partial cross-sectional view of the rear plate, taken along the line 3—3 of FIG. 2, and illustrating the shape of a radial recess formed in the end face of the rear plate element.

In the viscous fluid type heat generator according to the first embodiment, the rear plate element 3 has the circular flat end face 3*a* defining a major part of the inner wall surfaces of the heat generating chamber 8, and provided with a plurality of (nine) radially elongate recesses 16 (FIG. 2) acting as a fluid shearing energizing means for applying a strong shearing action to the viscous fluid. The radially elongate recesses 16 are arranged equiangularly around the center of the circular flat end face 3*a*. Each of the radially elongate recess 16 has two acute edges 16*a* as best shown in FIG. 3. The circular flat end face 3*a* of the rear plate element 3 is further provided with one wide and elongate recess 17 arranged so that the center line of the recess 17 is angularly shifted by an angle "θ" ($0<\theta<45$, preferably, $10<\theta<30$) from a radial line of the circular flat end surface 3*a* of the rear plate element 3 in a direction corresponding to the rotating direction "P" (see FIG. 2) of the rotor element 15.

Figure 4:
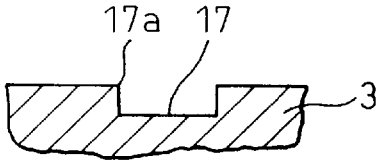
FIG. 4 is a partial cross-sectional view of the rear plate element, taken along the line 4—4 of FIG. 2, and illustrating the shape of an angularly shifted recess formed in the end face of the rear plate element.
Figure 5:
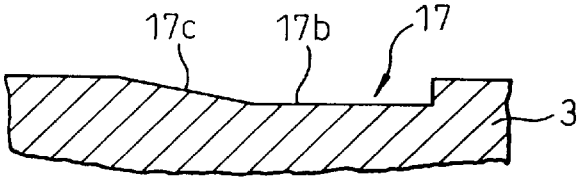
FIG. 5 is a partial cross-sectional view of the rear plate element, taken along the line 5—5 of FIG. 2, and illustrating the shape of the bottom portion of the angularly shifted recess.

The elongate recess 17 has two acute edges 17*a* shown in FIG. 4, and a bottom portion shown in FIG. 5 which includes a maximum depth flat bottom portion 17*b* and a sloping bottom portion 17*c* gradually ascending in a direction toward the outer periphery of the circular end surface 3*a* of the rear plate element 3. The maximum depth flat bottom portion 17*b* has a predetermined depth, e.g., approximately 2 mm, with respect to the circular end face 3*a* of the rear plate element 3.

Although not shown, it should be noted that the flat circular end face 2*a* of the front plate element 2 is also provided with a plurality of (nine) radially elongate recesses similar to the above-mentioned radially elongate recesses 16 and an angularly shifted recess similar to the above-mentioned wide elongate recess 17 of the rear plate element 3. The angularly shifted recesses 17 of the front and rear plates 2 and 3 function as a fluid outward supply means for urging the silicone fluid to move from a radially inner regions of the heat generating chamber 8 toward a radially outer region of the chamber 8 when the rotor element 15 rotates.

When the viscous fluid type heat generator of the first embodiment is incorporated in a heating system of an automobile, and when the drive shaft 14 is driven by an automobile engine via a belt and pulley transmission mechanism, the rotor element 15 is rotated within the cylindrical heat generating chamber 8. Thus, the silicone oil held between the entire outer faces of the rotor element 15 and the inner wall surfaces of the heat generating chamber 8 is subjected to a shearing action by the rotation of the rotor element 15. Therefore, the silicone oil generates heat which is transmitted to a heat exchanging liquid, typically water, flowing through the front and rear heat receiving chambers FW and RW. Thus, the heat is carried to a heating circuit of the heating system to warm an objective area of the automobile such as a passenger cabin.

When the rotor element 15 is rotated within the heat generating chamber 8, the viscous fluid, i.e., the silicone oil held in the entire outer faces of the rotor element 15 and the entire inner wall surfaces of the heat generating chamber 8 is forced to move with the rotor element 15 in the same direction as the rotating direction of the rotor element 15 because of a high viscosity of the silicone oil, and is subjected to the above-mentioned shearing action to generate heat.

At this stage, however, the above-mentioned angularly shifted elongate recesses 17 formed in the inner circular wall surfaces of the heat generating chamber 8, i.e., in the circular flat end face 2*a* of the front plate element 2 and the circular flat end face 3*a* of the rear plate element 3, allow a part of the viscous fluid to move generally toward an outer region of the heat generating chamber 8 in response to the rotation of the rotor element 15. Namely, the silicone oil held in the space located in the radially inner region of the heat generating chamber 8 is carried outward to the radially outer region of the heat generating chamber 8 through the elongate recesses 17 which are angularly shifted from radial lines in the rotating direction "P" of the rotor element 15 (see FIG. 2). Moreover, since each angularly shifted elongate recess 17 has the maximum bottom portion 17*b* having the depth larger than an axial amount of space between the end faces 15*a* and 15*b* of the rotor element 15 and the front and rear inner circular wall surfaces of the heat generating chamber 8, the recesses 17 can provide guide passageways allowing the viscous fluid to enter therein and to pass therethrough during the movement of the viscous fluid caused by the rotation of the rotor element 15. Further, since the sloping bottom portions 17*c* arranged in continuation to the maximum depth bottom portions 17*b* of the respective recesses 17 is formed so as to gradually ascend toward the inner flat end faces 2*a* and 3*a* of the front and rear plate elements 2 and 3, the silicone oil, i.e., the viscous fluid can smoothly move from the radially inner region toward the radially outer region of the heat generating chamber 8, and accordingly, the viscous fluid is effectively supplied to the radially outer region of the heat generating chamber 8 where the viscous fluid is subjected to a strong shearing action by the outer portion of the rotating rotor element 15.

Further, in the first embodiment, the plurality of radially elongate recesses 16 and the angularly shifted elongate recesses 17 of the inner wall surfaces of the heat generating chamber 8 act so as to provide a change in an extent of the space between the outer end faces 15*a* and 15*b* of the rotor element 15 and the inner wall surfaces of the heat generating chamber 8 in the circumferential direction of the heat generating chamber 8. Therefore, during the rotation of the rotor element 15, the viscous fluid moving with the rotor element 15 is subjected to a strong and effective shearing action due to the change in the extent of the fluid holding space. Furthermore, the plurality of radial recesses 16 and the two angularly shifted recesses 17 act to trap gas and air bubbles suspended in the viscous fluid during the rotation of the rotor element 15, and accordingly, the viscous fluid held between the opposite end faces 15*a* and 15*b* of the rotor element 15 and the inner wall surfaces of the heat generating chamber 8 except for the viscous fluid held in both recesses 16 and 17 can contain neither a gas nor air. Therefore, the shearing action applied to the viscous fluid can be stronger to enhance heat generation by the viscous fluid.

Furthermore, the acute edges 16*a* and 17*a* of the radial recesses 16 and the two angularly shifted elongate recesses 17 can give a large restraint to the movement of the viscous fluid having a chain molecular structure therein and moved by the rotor element 15, and accordingly, the shearing force applied to the viscous fluid is increased to promote efficient heat generation by the viscous fluid.

The acute edges 16*a* and 17*a* of the radial recesses 16 and the two angularly shifted elongate recesses 17 also can act to prevent the gas and air trapped by these recesses 16 and 17 from flowing away therefrom. Thus, the gas and air can be successfully held and stored within the recesses 16 and 17 during the operation of the viscous fluid type heat generator.

From the foregoing description, it will be understood that the viscous fluid heat generator of the first embodiment can efficiently generate a large amount of heat by the use of a shearing action applied to the viscous fluid.

In the viscous fluid heat generator of the first embodiment, the angularly shifted elongate recesses 17 formed in the circular end faces 2*a* and 3*a* of the front and rear plate elements 2 and 3 allow the viscous fluid, held in a region adjacent to the inner wall surfaces of the heat generating chamber 8, to move from the radially inner region toward the radially outer region of the heat generating chamber 8. This movement of the viscous fluid causes an increase in pressure prevailing in the radially outer region of the heat generating chamber 8. Nevertheless, the increase in the pressure of the viscous fluid in the radially outer region causes the viscous fluid held in a region adjacent to the end faces 15*a* and 15*b* of the rotor element 15 to move from the radially outer region toward the radially inner region of the heat generating chamber 8 during the rotation of the rotor element 15. Thus, a kind of circulating motion of the viscous fluid through the radially outer and inner regions of the heat generating chamber 8 occurs during the rotation of the rotor element 15 while causing the mixing of the viscous fluid. Therefore, the viscous fluid in the radially outer region of the heat generating chamber 8, having a high temperature, can be cooled by the viscous fluid in the radially inner region of the heat generating chamber 8, having a relatively low temperature. Therefore, the viscous fluid held in the radially outer region of the heat generating chamber 8 where a stronger shearing action is applied by the outer portion of the rotating rotor element 15 to the viscous fluid can be prevented from being excessively heated. Accordingly, the viscous fluid is not thermally degraded resulting in increasing the operation life of the viscous fluid.

The plurality of (nine) radial recesses 16 and the two angularly shifted elongate recesses 17 formed in the front and rear plate elements 2 and 3 can also function as a heat transmission promoting means for promoting heat transmission from the heat generating chamber 8 to the heat receiving chambers FW and RW. Namely, provision of the recesses 16 and 17 in the front and rear plate elements 2 and 3 can increase surface area of the heat generating chamber 8 by a surface area of the side walls of the respective recesses 16 and 17. Since heat is transmitted from the viscous fluid to the heat exchanging liquid in the heat receiving chambers FW and RW via the increased surface area of the heat generating chamber 8, an amount of heat transmitted from the heat generating chamber 8 to the heat receiving chambers FW and RW is accordingly increased. Therefore, an efficiency of heat generation of the viscous fluid type heat generator of the first embodiment of the present invention can be higher than the conventional viscous fluid type heat generator. The increase in the heat transmission from the heat generating chamber 8 to the heat receiving chambers FW and RW also contributes to suppressing confining of heat in the heat generating chamber 8. Accordingly, the viscous fluid is not excessively heated, and accordingly, the thermal degradation of the viscous fluid can be again prevented, so that the long operation life of the viscous fluid is guaranteed.

Figure 6:
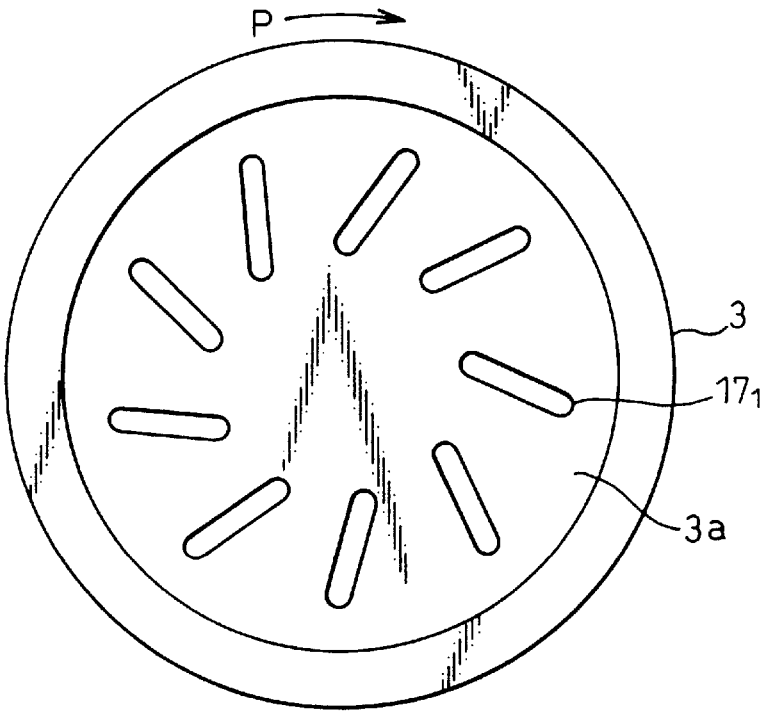
FIG. 6 is an end view of a rear plate element incorporated in the viscous fluid type heat generator of a second embodiment of the present invention, illustrating recesses formed in a circular end face of the rear plate element to be angularly shifted relative to radial lines of the rear plate.

FIG. 6 illustrates an important feature of a viscous fluid type heat generator according to a second embodiment of the present invention. Therefore, the other constructional features of this heat generator other than the feature shown in FIG. 6 may be understood as being equal to those of the heat generator of the first embodiment shown in FIG. 1.

Referring to FIG. 6, the rear plate element 3 is provided with a plurality of (nine) angularly shifted recesses $\mathbf{17}_1$ formed in the flat circular end face 3*a*. It should be noted that an equal number of similar angularly shifted recesses $\mathbf{17}_1$ are formed in the flat circular end face 2*a* of the front plate element 2.

It will be understood that each of the recesses $\mathbf{17}_1$ is arranged to be angularly shifted from a radial line of the end faces 2*a* and 3*a* in the same direction as the rotating direction "P" of the rotor element 15 of the viscous fluid type heat generator.

The provision of the angularly shifted recesses $\mathbf{17}_1$ allows the viscous fluid to move from the radially inner region toward the radially outer region of the heat generating chamber 8 during the rotation of the rotor element 15. Therefore, an efficient supply of the viscous fluid from the radially inner region to the radially outer region of the heat generating chamber 8 can be achieved. Thus, during the rotation of the rotor element 15, an amount of heat generation by the viscous fluid can be increased. Further, the angularly shifted recesses $\mathbf{17}_1$ can also contribute to providing the viscous fluid with a circulating movement passing the radially inner and outer regions of the heat generating chamber 8 in response to the rotation of the rotor element 15 because of a pressure differential between the fluid pressure in the radially inner region and that in the outer region. Thus, thermal degradation of the viscous fluid can be effectively prevented even if the viscous fluid type heat generator is continuously operated for a long time.

Figure 7:
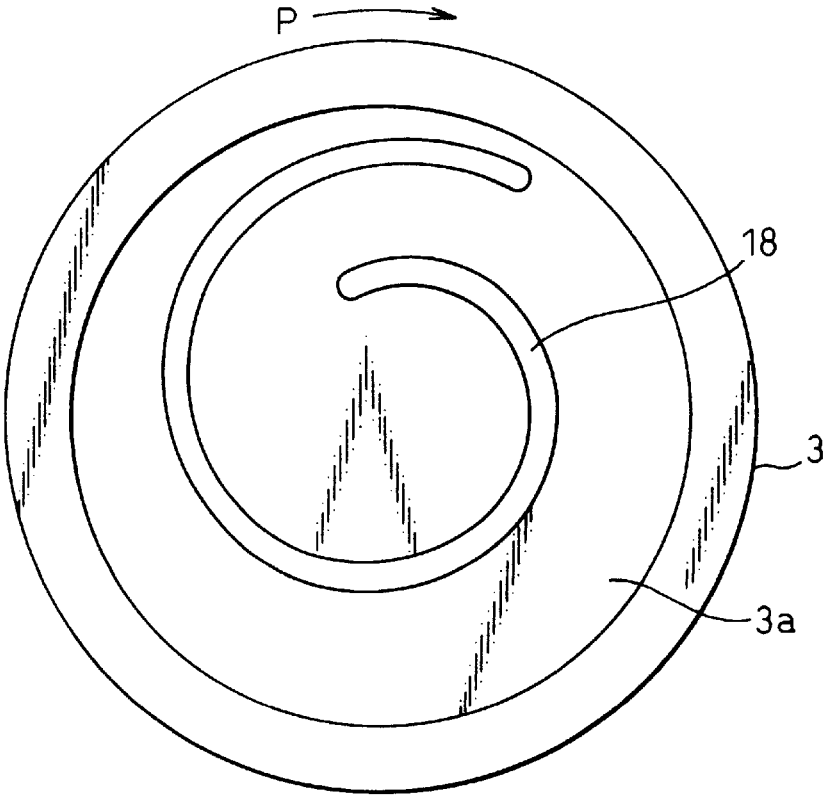
FIG. 7 is an end view of a rear plate element incorporated in the viscous fluid type heat generator of a third embodiment of the present invention, illustrating a spiral recess formed in a circular end face of the rear plate element.

FIG. 7 illustrates an important feature of a viscous fluid type heat generator according to a third embodiment of the present invention. Therefore, the other constructional features of this heat generator other than the feature shown in FIG. 7 may be understood as being equal to those of the heat generator of the afore-mentioned first embodiment shown in FIG. 1.

In FIG. 7, the rear plate element 3 is provided with a spiral recess 18 formed in the circular flat end face 3*a* thereof. An equal spiral recess 18 is formed in the circular flat end face 2*a* of the front plate element 2. The spiral recesses 18 formed in the front and rear plates 2 and 3, i.e., in the inner front and rear wall surfaces of the heat generating chamber 8 are arranged so as to extend from a radially inner portion of each of the circular flat end faces 2*a* and 3*a* toward a radially outer portion thereof in the same direction as the rotating direction "P" of the rotor element 15. Namely, Each spiral recess 18 is formed as a recess which extends so as to curve relative to radial lines of the circular flat end face 2*a* or 3*a* in a direction corresponding to the rotating direction "P" of the rotor element 15. Therefore, the spiral recesses 18 of the inner wall surfaces of the heat generating chamber 8 can function as a fluid outward supply means for urging the viscous fluid held in the radially inner region of the heat generating chamber 8 to move toward the radially outer region of the heat generating chamber 8 during the rotation of the rotor element 15. Therefore, the viscous fluid type heat generator of the third embodiment provided with the spiral recesses 18 formed in the front and rear inner wall surfaces of the heat generating chamber 8 is able to use the spiral recesses 18 so as cause a smooth movement of the viscous fluid from the radially inner region to the radially outer region of the heat generating chamber 8. Therefore, when the operation of the viscous fluid type heat generator of the third embodiment is started, an increase in the amount of heat generation can be quickly achieved. Further, the spiral recesses 18 can also contribute to causing a circulating movement of the viscous fluid within the heat generating chamber 8 during the rotation of the rotor element 15, because of a pressure differential between the fluid pressures in the radially inner and outer regions of the heat generating chamber 8. Therefore, thermal degradation of the viscous fluid can be effectively reduced for a long operation life of the viscous fluid type heat generator.

Figure 8:
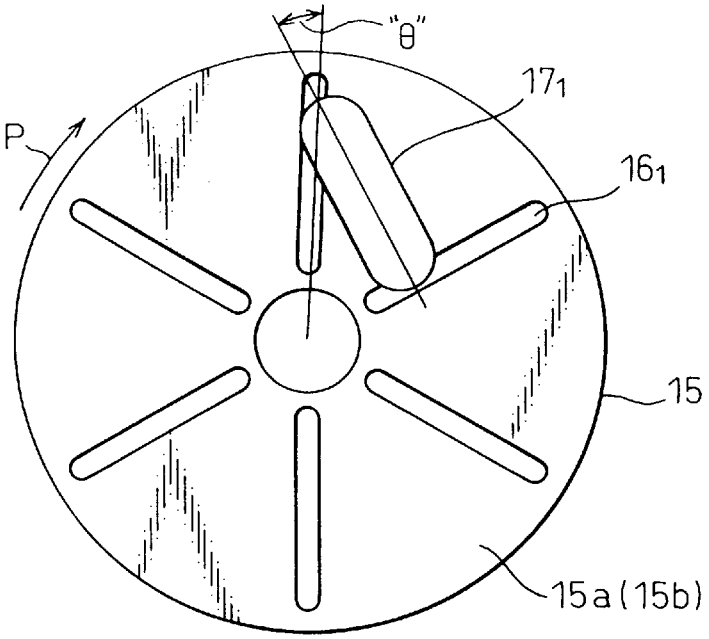
FIG. 8 is an end view of a rotor element incorporated in a viscous fluid type heat generator of a fourth embodiment of the present invention, illustrating radial recesses and an angularly shifted recess formed in an end face of the rotor element.

FIG. 8 illustrates an important feature of a viscous fluid type heat generator according to a fourth embodiment of the present invention. Therefore, the other constructional features of this heat generator other than the feature shown in FIG. 8 may be understood as being equal to those of the heat generator of the afore-mentioned first embodiment shown in FIG. 1.

In FIG. 8, the viscous fluid type heat generator of the fourth embodiment is provided with a disc like rotor element 15 having opposite end faces 15*a* and 15*b* in which a plurality of (six) radial elongate recesses $\mathbf{16}_1$ and an angularly shifted wide recess $\mathbf{17}_1$ are formed, respectively. It should be understood that the angularly shifted recesses $17_1$ of the end faces 15*a* and 15*b* of the rotor element 15 are arranged so that the center line of the respective recesses $17_1$ is angularly shifted by an angle "θ" (0<θ<45) from a radial line in a direction reverse to the rotating direction of the rotor element 15.

Since the viscous fluid type heat generator of the fourth embodiment is provided with the angularly shifted recesses $17_1$ formed in the opposite end faces of the disc like rotor element 15 in addition to the angularly shifted recesses 17 formed in the front and rear wall surfaces of the heat generating chamber 8, the movement of the viscous fluid from the radially inner region to the radially outer region of the heat generating chamber 8 is effectively promoted so that supply of the viscous fluid from the radially inner region to the radially outer region of the heat generating chamber 8 is increased.

Further, the plurality of radial elongate recesses $16_1$ of the end faces 15*a* ad 15*b* of the rotor element 15 can cooperate with the radial elongate recesses 16 of the front and rear wall surfaces of the heat generating chamber 8 so as to apply stronger shearing action to the viscous fluid within the heat generating chamber 8. Therefore, an mount of heat generation of the viscous fluid of the heat generator of the fourth embodiment can be further increased compared with the aforementioned heat generator of the first embodiment. At this stage, according to the fourth embodiment, the viscous fluid type heat generator is provided with nine radial elongate recesses 16 in each of the front and rear wall surfaces of the heat generating chamber and six radial elongate recesses $16_1$ in each of the end faces 15*a* and 15*b* of the rotor element 15. Namely, the angular space between the two recesses 16 and that between the two recesses $16_1$ are different from one another. Thus, during the rotation of the rotor element 15, all of the radial elongate recesses $16_1$ of the rotor element 15 do not simultaneously come into registration with the radial elongate recesses 16 of the wall surfaces of the heat generating chamber 8. Therefore, during the rotation of the rotor element 15, vibration of the heat generator and generation of noise due to a change in the torque of the rotor element 15 can be successfully suppressed.

Figure 9:
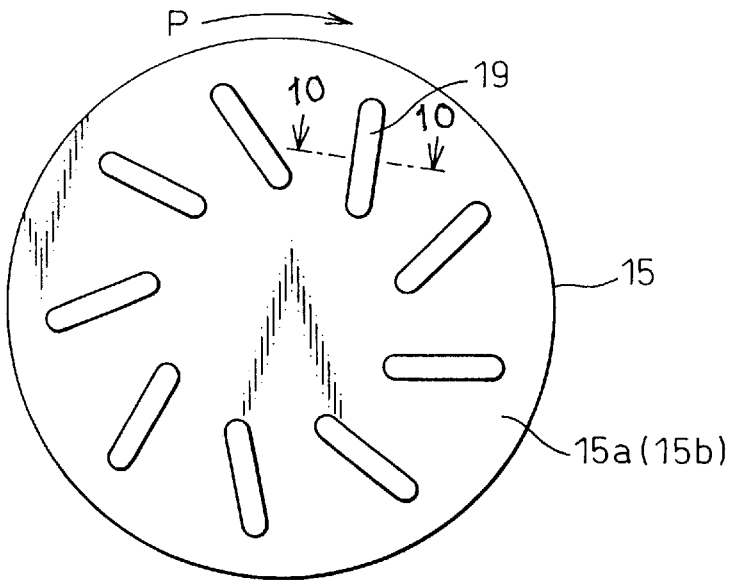
FIG. 9 is an end view of a rotor element incorporated in a viscous fluid type heat generator of a fifth embodiment of the present invention, illustrating a plurality of ridges formed in an end face of the rotor element.
Figure 10:
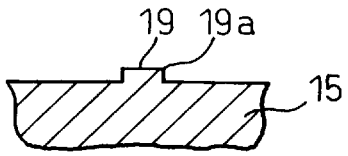
FIG. 10 is a cross-sectional view of a part of the rotor element of FIG. 9, taken along the line 10—10, and illustrating the shape of the ridge.

FIGS. 9 and 10 illustrate an important feature of a viscous fluid type heat generator according to a fifth embodiment. Therefore, the other constructional features of this heat generator other than the feature shown in FIG. 9 may be understood as being equal to those of the heat generator of the first embodiment of FIG. 1.

In FIG. 9, the viscous fluid type heat generator is provided with a disc like rotor element 15 having opposite end faces 15*a* and 15*b* on which a plurality of angularly shifted ridges 19 are integrally supported. Each of the ridges 19 is arranged so as to be angularly shifted with respect to a radial line of the end face 15*a* or 15*b* in a direction reverse to the rotating direction "P" of the rotor element 15. Therefore, the angularly shifted ridges 19 of the rotor element 15 can act as a fluid outward supply means for urging the viscous fluid within the heat generating chamber 8 to move from the radially inner region to the radially outer region of the heat generating chamber 8 during the rotation of the rotor element 15.

Further, as shown in FIG. 10, the angularly shifted ridges 19 are formed with acute edges 19*a* acting so as to apply a restraint to the molecules of the viscous fluid having a chain molecular structure therein during the circumferential movement of the viscous fluid caused by the rotation of the rotor element 15. Therefore, the viscous fluid is subjected to a strong shearing action by the rotation of the rotor element 15. Therefore, the viscous fluid type heat generator of the fifth embodiment of FIGS. 9 and 10 can have a function not only to supply the viscous fluid from the radially inner region to the radially outer region of the heat generating chamber 8 but also to apply a strong shearing action to the viscous fluid during the rotation of the rotor element 15. Thus, the heat generator of the fifth embodiment can generate an increased amount of heat without causing an increase in the overall size of the heat generator.

FIGS. 11 through 14 illustrate a viscous fluid type heat generator of a sixth embodiment of the present invention.

Figure 11:
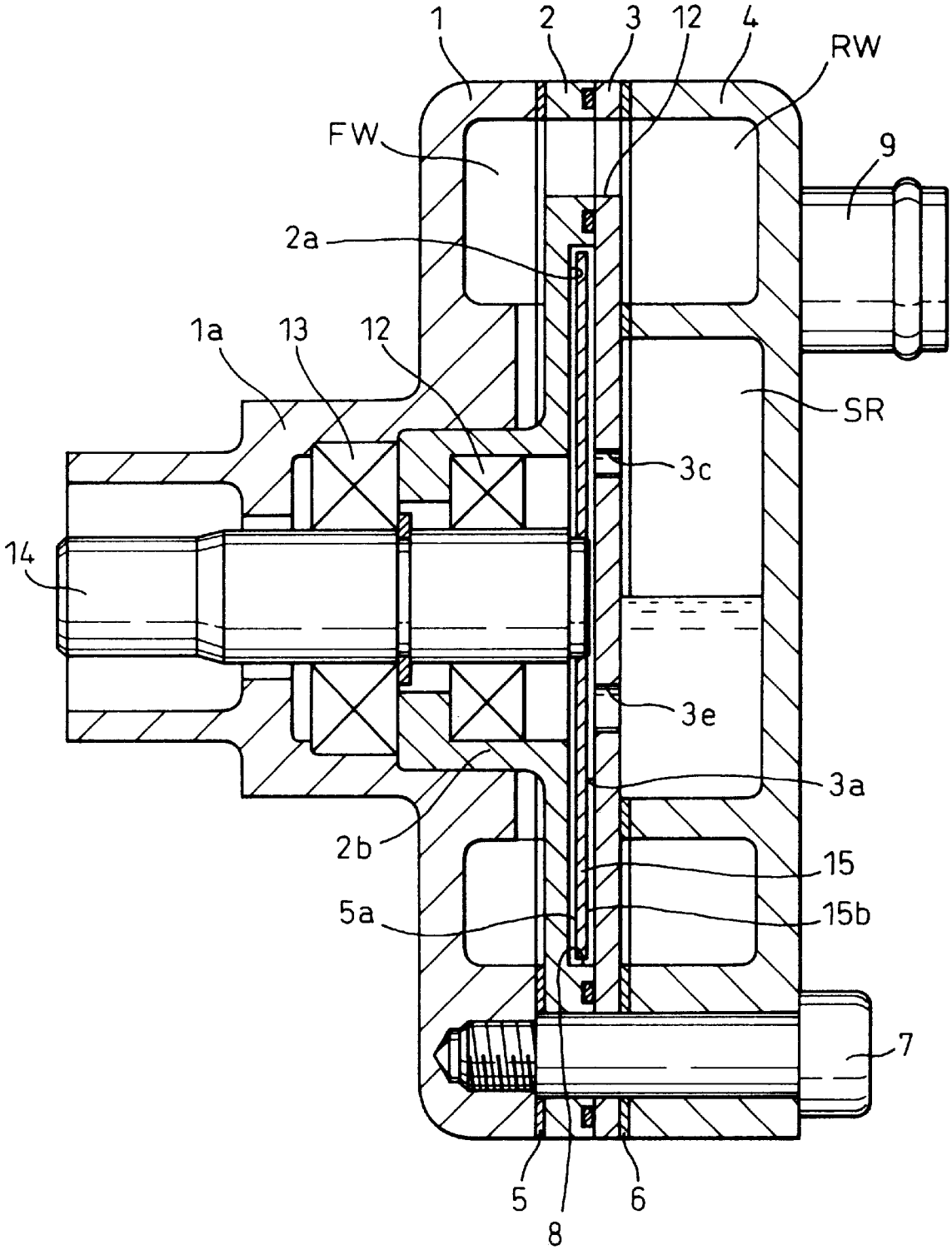
FIG. 11 is a longitudinal cross-sectional view of a viscous fluid type heat generator according to a sixth embodiment of the present invention.
Figure 12:
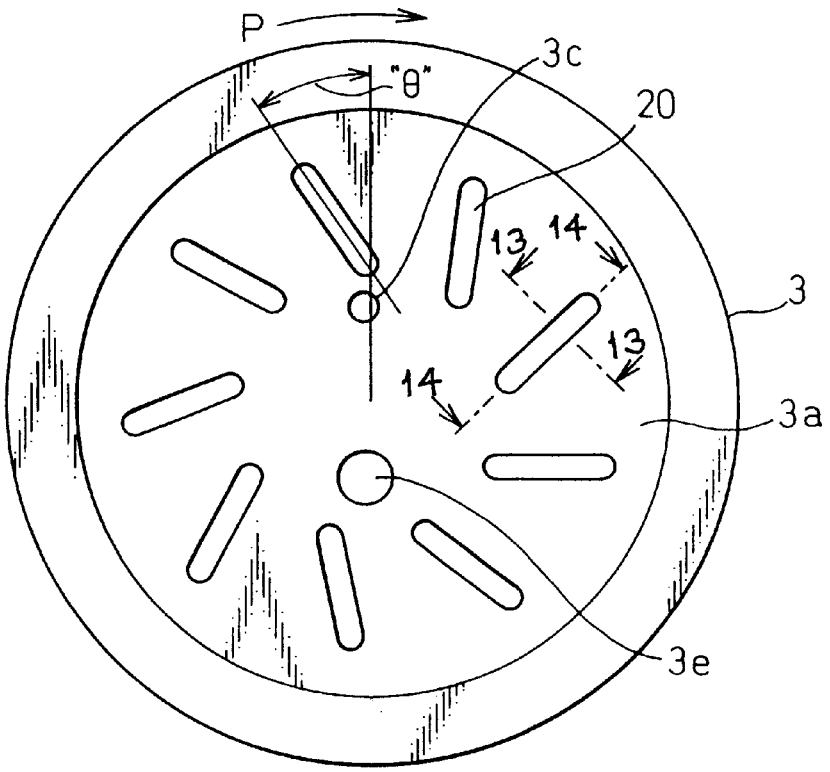
FIG. 12 is an end view of a rear plate element incorporated in the viscous fluid type heat generator of the sixth embodiment of the present invention.

From the illustration of FIG. 11, it will be understood that the viscous fluid type heat generator of this embodiment is different from the heat generator of the first embodiment of FIG. 1 in that the rear housing body 4 is provided with a centrally arranged fluid storing chamber SR for storing the viscous fluid. The fluid storing chamber SR of the rear housing body 4 fluidly communicates with the heat generating chamber 8 via a through hole 3*c* formed in the rear plate element 3 at a position above the center of the same element 3, and a larger through hole 3*e* formed in the rear plate element 3 at a position below the center of the same element 3. The smaller through hole 3*c* is provided for withdrawing the viscous fluid from the heat generating chamber 8 into the fluid storing chamber SR,and the larger through hole 3*e* is provided for supplying the viscous fluid from the fluid storing chamber SR to the heat generating chamber 8.

Further, the inner end face 3*a* of the rear plate element 3 of the viscous fluid type heat generator of the sixth embodiment is provided with a plurality of (nine) elongate recesses 20 which are arranged to be angularly shifted by an angle "θ" in a direction reverse to the rotating direction "P" of the rotor element 15. The above-mentioned angle "θ" can be selected to be an angle ranging from 10 through 45 degrees.

Figure 13:
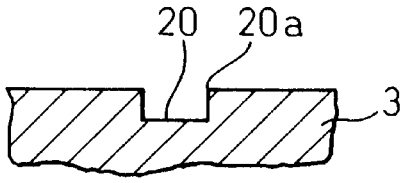
FIG. 13 is a cross-sectional view of a part of the rear plate element of the heat generator of the sixth embodiment, taken along the line 13—13 of FIG. 12, and illustrating the shape of a recess formed in an end face of the rear plate element.
Figure 14:
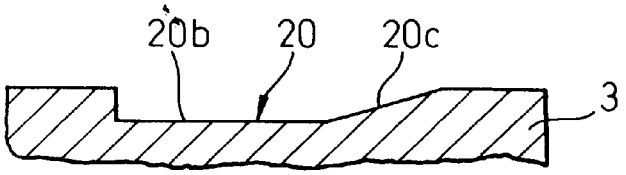
FIG. 14 is a cross-sectional view, taken along the line 14—14 of FIG. 12, and illustrating the shape of a sloping bottom of the recess.

Each of the angularly shifted recesses 20 has a pair of acute edges 20*a* as shown in FIG. 13, and a maximum depth bottom portion 20*b* and a sloping bottom portion 20*c* arranged in continuation to the maximum depth bottom portion 20*b* as shown in FIG. 14. The maximum depth bottom portion 20*b* of the recess 20 has a predetermined depth, e.g., 2 mm, which may be experimentally decided. The sloping bottom portion 20*c* of the recess 20 is formed so as to gradually ascend toward an end of the recess 20, located on the radially inner side of the end face 3*a* of the rear plate element 3.

It should be understood that the front plate element 2 defining one inner wall surface of the heat generating chamber 8 is also provided with a plurality of (nine) similar angularly shifted recesses 20 formed in the circular flat end face 2*a* thereof.

In the above-described sixth embodiment of the present invention, the angularly shifted elongate recesses 20 formed in the front and rear inner wall surfaces of the heat generating chamber 8 act so as to urge the viscous fluid held in the radially outer region of the heat generating chamber 8 to move therefrom toward the radially inner region of the heat generating chamber 8 in response to the rotation of the rotor element 15. Namely, these angularly shifted recesses 20 of the inner wall surfaces of the heat generating chamber 8 constitute a fluid inward supply means for supplying the viscous fluid from the radially inner region to the radially outer region within the heat generating chamber 8 during the rotation of the rotor element 15.

The other constructional features of the viscous fluid type heat generator of the sixth embodiment of FIG. 11 are similar to those of the heat generator of the first embodiment shown in FIG. 1.

In the viscous fluid type heat generator, when the rotor element 15 is rotated at a low speed, the fluid inward supply performance of the angularly shifted elongate recesses 20 of the inner wall surfaces of the heat generating chamber 8 is not effective, and therefore, the movement of the viscous fluid from the radially outer region to the radially inner region of the heat generating chamber 8 is not remarkable. Accordingly, the viscous fluid held in the radially outer region of the heat generating chamber 8 is subjected to a strong shearing action exerted by the outer portion of the rotor element 15, and generates a large amount of heat.

When the rotor element 15 is rotated at a high speed, the viscous fluid held in the radially outer region of the heat generating chamber 8 is urged to move toward the radially inner region by the angularly shifted elongate recesses 20 formed in the inner wall surfaces of the heat generating chamber 8 acting as the fluid inward supply means, and by the known Weissenberg Effect. Namely, the viscous fluid is effectively collected toward the radially inner region of the heat generating chamber 8. At this stage, since the respective angularly shifted elongate recesses 20 have the maximum depth bottom portion 20*b*, respectively, which has a depth larger than an amount of space between each of the end faces 15*a* and 15*b* of the rotor element 15 and inner wall surfaces of the heat generating chamber 8, the recesses 20 can provide guide passageways allowing the viscous fluid to enter therein and to pass therethrough during the movement of the viscous fluid caused by the rotation of the rotor element 15. Further, since the sloping bottom portions 20*c* arranged in continuation to the maximum depth bottom portions of the respective recesses 20 are formed so as to gradually ascend toward the respective ends of the recesses 20, located on the radially inner side of the flat circular end faces 2*a* and 3*a* of the front and rear plate elements 2 and 3, the viscous fluid can smoothly move from the radially outer region to the radially inner region of the heat generating chamber 8. Namely, the viscous fluid is effectively supplied to the radially inner region of the heat generating chamber 8. Therefore, even when the rotor element 15 is rotated at a high speed, since a large part of the viscous fluid in the heat generating chamber 8 is collected in the radially inner region thereof where a relatively small shearing action is applied to the viscous fluid by the inner portion of the rotating rotor element 15, heat generation by the viscous fluid can be suppressed. Therefore, the thermal degradation of the viscous fluid can also be prevented.

Further, in the viscous fluid type heat generator according to the embodiment of FIG. 11, the fluid storing chamber SR can store a predetermined volume of viscous fluid which is larger than the overall capacity of the fluid holding space in the heat generating chamber 8, it is not needed to accurately and precisely determine a filling amount of viscous fluid when it is initially filled into the heat generating chamber 8.

Since the fluid storing chamber SR of the rear housing body 4 communicates with the heat generating chamber 8 via the withdrawing through hole 3*c* and the supply through hole 3*e*, the viscous fluid collected in the radially inner region of the heat generating chamber 8 by the Weissenberg effect and by the fluid inward supply means constituted by the angularly shifted elongate recesses 20 can be withdrawn from the heat generating chamber 8 into the fluid storing chamber SR through the fluid withdrawing through hole 3*c*. Further, it is possible to supply the viscous fluid from the fluid storing chamber SR to the heat generating chamber 8 through the fluid supply through hole 3*e*. Thus, in the viscous fluid type heat generator of the sixth embodiment, replacement of the viscous fluid in the heat generating chamber 8 by that in the fluid storing chamber SR can be carried out, and a suitable amount of viscous fluid can be supplied into the heat generating chamber 8 so as to allow a sufficient amount of heat to be generated in the heat generating chamber 8. Further, since the viscous fluid within the heat generating chamber 8 is thermally expanded, a part of the viscous fluid can flow into, and be received by, the fluid storing chamber SR, a high fluid pressure is not applied to the shaft sealing device 12. Therefore, a good fluid sealing performance of the shaft sealing device 12 can be maintained for a long operation life thereof.

Still further, since the fluid storing chamber SR can be store the viscous liquid whose volume is larger than the capacity of the space within the heat generating chamber 8, and since the viscous fluid held within the heat generating chamber 8 can be constantly replaced and refreshed by the viscous fluid in the fluid storing chamber SR, the same viscous fluid is not always subjected to the shearing action within the heat generating chamber, and accordingly, the thermal degradation of the viscous fluid due to the constant heat generation can be suppressed.

Furthermore, the viscous fluid held in a portion of the space adjacent to the circular inner wall surfaces of the heat generating chamber 8 is urged to move from the radially outer region of the heat generating chamber 8 to the radially inner region thereof by the angularly shifted elongate recesses 20, and the viscous fluid held in a portion of the space adjacent to the opposite end faces 15*a* and 15*b* of the rotor element 15 is urged to move from the radially inner region of the heat generating chamber 8 to the radially outer region thereof due to an increase in a fluid pressure prevailing in the radially inner region of the heat generating chamber 8. Therefore, a circulatory movement of the viscous fluid occurs between the radially inner and outer regions of the heat generating chamber 8 during the rotation of the rotor element 15. Therefore, the mixing of the viscous fluid within the heat generating chamber 8 occurs to suppress a rise in the temperature of the viscous fluid within the heat generating chamber 8. Thus, the thermal degradation of the viscous fluid can be prevented so as to ensure a long operation life of the viscous fluid.

Further, the angularly shifted elongate recesses 20 of the inner wall surfaces of the heat generating chamber 8 promote transmission of heat from the viscous fluid within the chamber 8 to the heat exchanging liquid flowing through the front and rear heat receiving chambers FW and RW. Namely, the angularly shifted elongate recesses 20 can function as heat transmission promoting means. Therefore, an efficient heat transmission of heat from the heat generating chamber 8 to the front and rear heat receiving chamber FW and RW can be achieved to result in an increase in the heat generating efficiency of the viscous fluid type heat generator. Moreover, the efficient transmission of heat from the heat generating chamber 8 to the front and rear heat receiving chamber FW and RW contributes to suppressing confining of heat in the heat generating chamber 8. This is also effective for suppressing thermal degradation of the viscous fluid during the operation of the viscous fluid type heat generator, and accordingly, a long operation life of the viscous fluid can be guaranteed.

Figure 15:
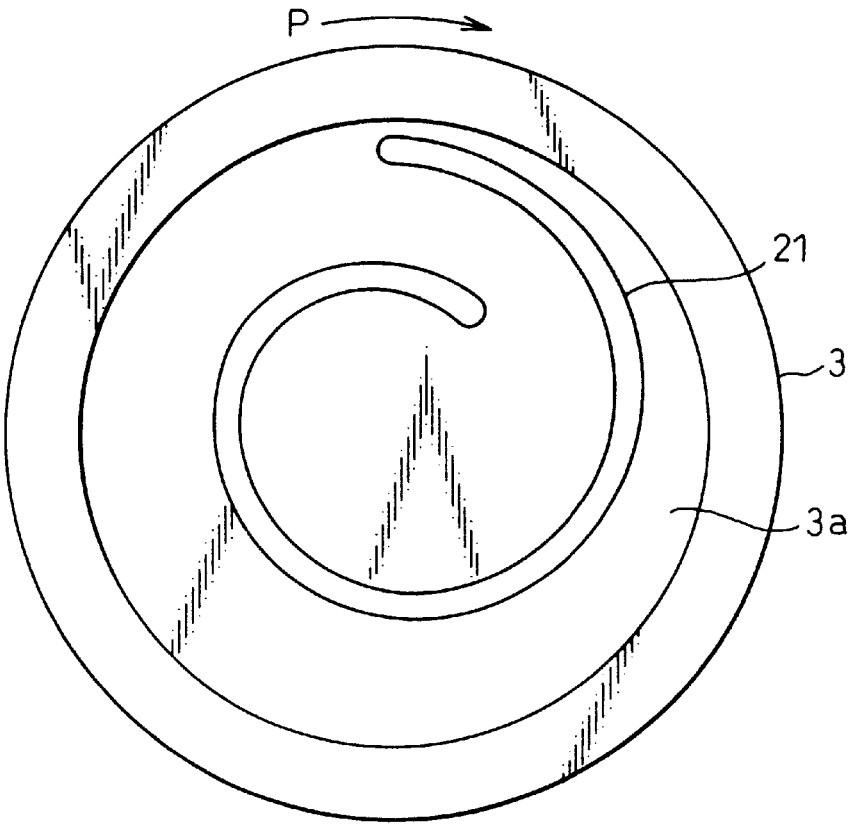
FIG. 15 is an end view of a rear plate element incorporated in a viscous fluid type heat generator of a seventh embodiment of the present invention, illustrating a spiral recess formed in the rear plate element.

FIG. 15 illustrates a seventh embodiment of the present invention, in which the rear plate element 3 has a circular flat end face 3*a* forming a rear inner wall surface of the heat generating chamber of the viscous fluid type heat generator, and provided with a spiral recess 21 formed therein. A similar spiral recess 21 is provided in a circular flat end face of the front plate element 2, which forms a front inner wall surface of the heat generating chamber 8. It should be understood that the other inner construction of the viscous fluid type heat generator is similar to that of the heat generator of the sixth embodiment, shown in FIG. 11.

The spiral recesses 21 formed in the circular end faces 2*a* and 3*a* of the front and rear plate elements 2 and 3 are arranged to spirally extend from a radially inner portion of the respective end faces 2*a* and 3*a* toward a radially outer portion thereof in a direction reverse to the rotating direction "P" of the rotor element 15. Namely, each of the spiral recesses 21 of the front and rear plate elements is arranged to be curved in a direction reverse to the rotating direction of the rotor element 15 with respect to radial lines in the circular end faces 2*a* and 3*a* of the front and rear plate elements 2 and 3, so that the viscous fluid held in the radially outer region of the heat generating chamber 8 is urged to move toward the radially inner region thereof. Therefore, during the rotation of the rotor element 15, the spiral recesses 21 of the front and rear plate elements 2 and 3 function as a fluid inward supply means for providing spiral passageways along which the viscous fluid is moved and supplied from the radially outer portion of the heat generating chamber 8 to the radially inner portion thereof where the shearing action given by the radially inner portion of the rotor element 15 is less strong. Accordingly, the heat generation by the viscous fluid is suppressed, and accordingly, the viscous fluid per se is not excessively heated. Further, since the viscous fluid is provided with a generally circulatory movement through the radially outer and inner regions of the heat generating chamber 8 to constantly cause mixing of the viscous fluid within the heat generating chamber 8. Thus, the high temperature viscous fluid held in the radially outer region is mixed with and cooled by the low temperature viscous fluid in the radially inner region of the heat generating chamber 8. As a result, thermal degradation of the viscous fluid can be effectively suppressed.

Figure 16:
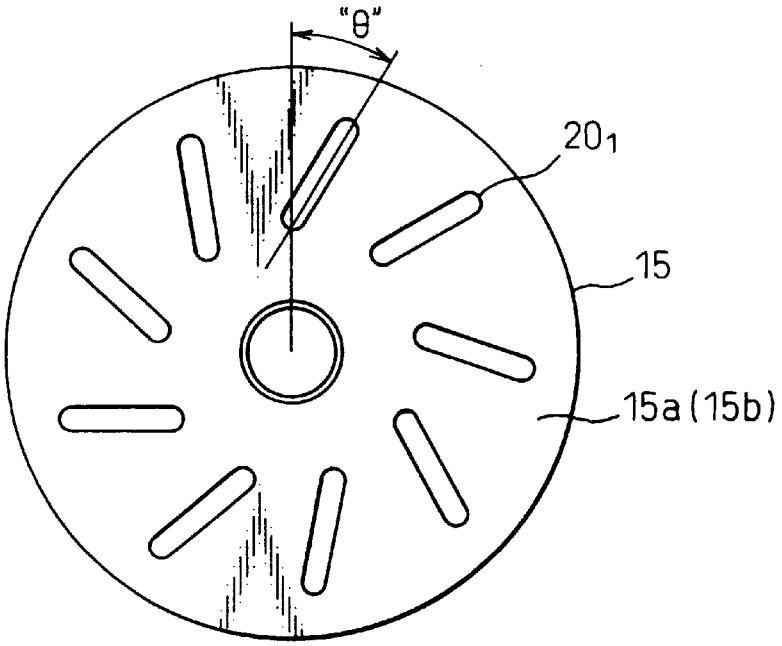
FIG. 16 is an end view of a rotor element incorporated in a viscous fluid type heat generator of an eighth embodiment of the present invention, illustrating a plurality of recesses formed in a circular end face of the rear plate element and angularly shifted relative to radial lines of the end face.

FIG. 16 illustrates an eighth embodiment of the present invention. The embodiment of FIG. 16 is different from the seventh embodiment of FIG. 15 in that the opposite end faces 15*a* and 15*b* of the rotor element is provided with a plurality of (nine) angularly shifted elongate recesses $\mathbf{20}_1$ equiangularly arranged in a circumferential direction about the center of the respective end faces 15*a* and 15*b*. The other construction of the viscous fluid type heat generator of the eighth embodiment is similar to that of the heat generator of the seventh embodiment. The center line of each angularly shifted elongate recesses $\mathbf{20}_1$ is inclined from a radial line of the end face 15*a* or 15*b* by an angle "θ" in a direction corresponding to the rotating direction "P" of the rotor element 15. These angularly shifted elongate recesses $\mathbf{20}_1$ of the opposite end faces 15*a* and 15*b* of the rotor element 15 can positively assist the viscous fluid to move from the radially outer region to the radially inner region within the heat generating chamber 8 in response to the rotation of the rotor element 15. Further, the angularly shifted elongate recesses $\mathbf{20}_1$ also cause a generally circulatory movement of the viscous fluid within the heat generating chamber 8, Thus, the viscous fluid is not excessively heated in the radially outer region, and accordingly, the thermal degradation of the viscous fluid is further effectively suppressed compared with the viscous fluid type heat generator of the afore-described seventh embodiment. Therefore, the viscosity of the viscous fluid can be kept stable for a long operation life of the viscous fluid type heat generator.

Figure 17:
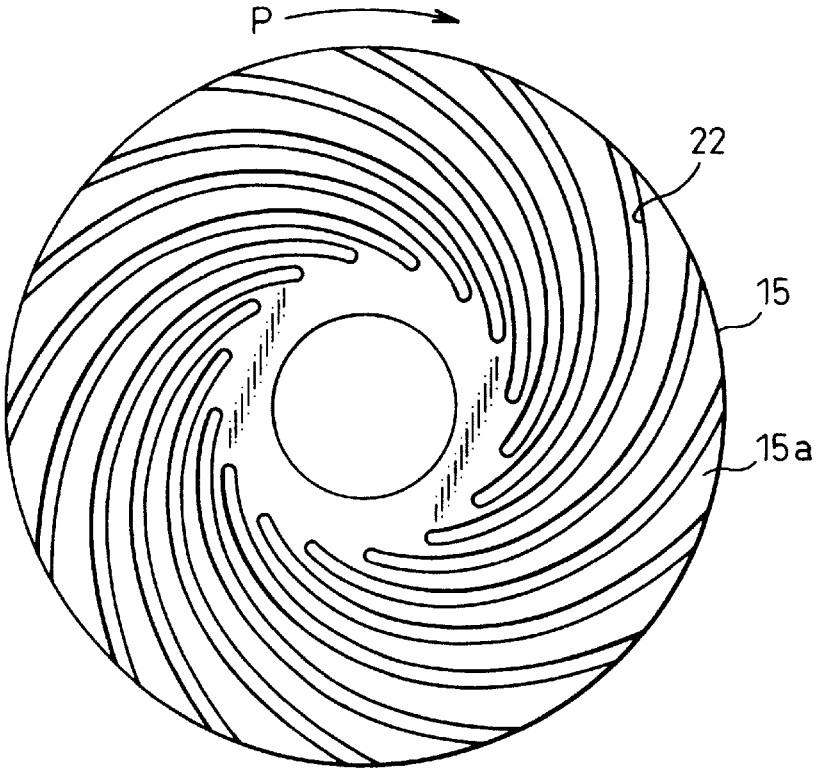
FIG. 17 is an end view of a rotor element incorporated in a viscous fluid type heat generator of a ninth embodiment of the present invention, illustrating a plurality of spiral recesses formed in a circular end face of the rear plate element.

FIG. 17 illustrates a ninth embodiment of the present invention.

The viscous fluid type heat generator of the ninth embodiment is provided with a rotor element 15 having opposite end faces 15*a* and 15*b* in which a plurality of (sixteen) spiral recesses 22 are formed therein, respectively. These spiral recesses 22 are curved so as to spirally extend in a direction reverse to the rotating direction "P" of the rotor element 15. An outermost end of each spiral recess 22 is terminated at the outer periphery of the rotor element 15, and an innermost end of each spiral recess is located at a position adjacent to a central bore of the rotor element 15 by which the rotor element 15 is mounted on the drive shaft 14.

It should be understood that, in response to the rotation of the rotor element 15 within the heat generating chamber 8, the spiral recesses 22 can urge the viscous fluid to generally move from the radially inner region toward the radially outer region of the heat generating chamber 8. Namely, the spiral recesses 22 of the rotor element 15 can function as a fluid outward supply means for supplying the viscous fluid from the radially inner region to the radially outer region, so that the heat generation by the viscous fluid in the radially outer region is increased. The other construction of the viscous fluid type heat generator of this embodiment corresponds to the construction of the heat generator of the first embodiment except that the inner circular wall surfaces of the heat generating chamber 8 are not provided with an angularly shifted wide and elongate recesses 17 (see FIG. 2).

When the rotor element 15 is rotated by the drive shaft 14, the sixteen spiral recesses 22 of both end faces 15*a* and 15*b* of the rotor element 15 urge the viscous fluid in the heat generating chamber 8 to generally move from the radially inner region to the radially outer region where a strong shearing action is applied by the outer portion of the rotor element 15. Thus, an efficient heat generation by the viscous fluid within the heat generating chamber 8 is carried out. Particularly, since the sixteen spiral recesses 22 are formed so as to provide the viscous fluid with long passageways extending from a position adjacent to the radially innermost region to a position adjacent to the radially outermost region in the chamber 8, the viscous fluid can be surely supplied from the radially inner region to the radially outer region of the heat generating chamber 8. Therefore, not only efficient heat generation by the viscous fluid in the heat generating chamber but also suppression of the thermal degradation of the viscous fluid can be achieved by the viscous fluid type heat generator of the ninth embodiment.

At this stage, the spiral recesses 22 of the rotor element 15 permit the viscous fluid held in portion of the heat generating chamber 8 adjacent to the end faces 15*a* and 15*b* of the rotor element 15 to be supplied from the radially inner region to the radially outer region. Then, a pressure of the viscous fluid prevailing in the radially outer portion of the heat generating chamber 8 is increased. Thus, a pressure differential appears between the radially outer region and the radially inner region of the chamber 8, and accordingly, the viscous fluid in the radially outer region is urged to move toward the radially inner region through a portion of the chamber 8 located adjacent to the front and rear inner wall surfaces of the heat generating chamber 8, especially through a plurality of radial recesses 16 (see FIG. 2) formed in the inner wall surfaces of the heat generating chamber 8. Therefore, a circulatory movement of the viscous fluid between the radially outer and inner regions in the chamber 8 occurs. Therefore, the viscous fluid is not excessively heated in the radially outer region of the heat generating chamber 8. It should be noted that each of the spiral recesses 22 of the rotor element 15 is curved with respect to a radial line of the end face 15*a* or 15*b* by an angle selected from an angular range of 10 through 45 degrees.

Figure 18:
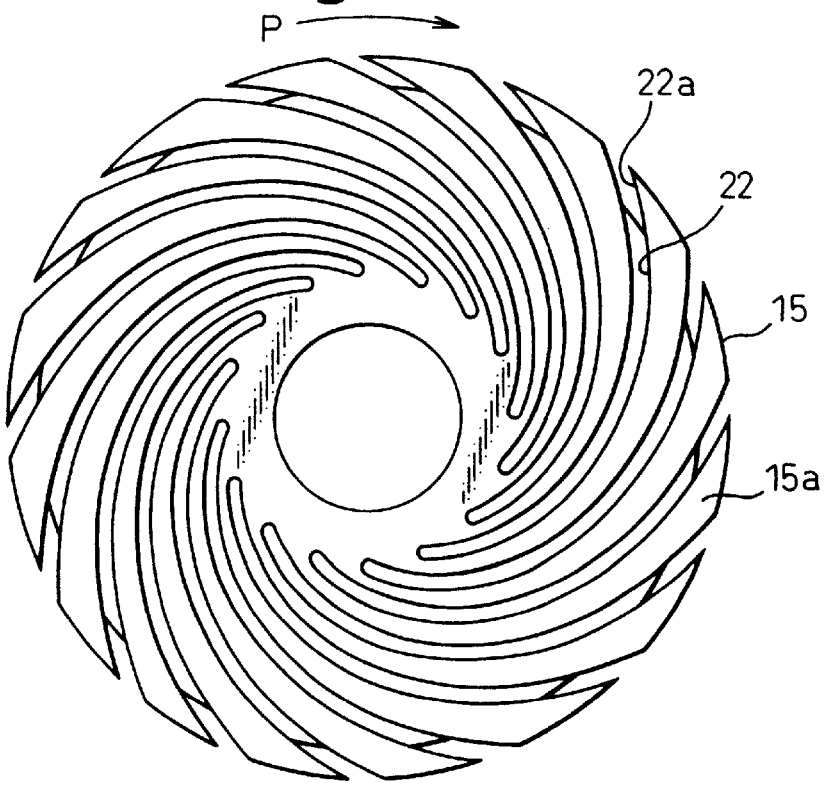
FIG. 18 is an end view of a rotor element incorporated in a viscous fluid type heat generator of a tenth embodiment of the present invention, illustrating a plurality of spiral recesses formed in a circular end face of the rear plate element but modified from the spiral recesses of FIG. 17.

FIG. 18 illustrates a tenth embodiment of the present invention.

A viscous fluid type heat generator according to the tenth embodiment of FIG. 18 is characterized in that the rotor element 15 is provided with a plurality of (sixteen) spiral recesses 22 formed in the opposite end faces 15*a* and 15*b* thereof, and a plurality of cuts 22*a* formed at respective outermost ends of the spiral recesses 22. Each of the cuts 22*a* is formed in the shape of a spirally extending cut. The spiral recesses 22 and the spiral cuts 22*a* are curved to spirally extend in a direction reverse to the rotating direction "P". It should be understood that the other constructions of the heat generator of the tenth embodiment are similar to those of the heat generator of the above-described ninth embodiment.

The plurality of spiral cuts 22*a* of the rotor element 15 permit the viscous fluid to pass therethrough from one side to the other side of the rotor element 15. Therefore, the viscous fluid held on both sides of the rotor element 15 can have an equal fluid pressure. This fact permits the viscous fluid held on both sides of the rotor element 15 within the heat generating chamber 8 to generate heat equally on both sides of the rotor element 15.

The plurality of spiral cuts 22*a* of the rotor element 15 also contribute to a quick start of heat generating operation performed by the viscous fluid when the operation of the viscous fluid type heat generator is started. Namely, since the viscous fluid type heat generator is usually mounted in a horizontal posture where the axis of rotation of the rotor element 15 is kept substantially horizontal, when the operation of the heat generator is stopped, the viscous fluid within the heat generating chamber 8 flows down, due to its weight, into the radially inner region of the chamber 8 to be held there. However, when the viscous fluid type heat generator is started, the spiral cuts 22 formed in the outer periphery of the rotor element 15 quickly hold the viscous fluid, and carry it from the radially inner region of the chamber 8 toward the radially outer region of the chamber 8 in response to the rotation of the rotor element 15. As a result, the viscous fluid can be distributed to all of the heat generating regions in the heat generating chamber 8 formed between the inner wall surfaces of the chamber 8 and the outer faces of the rotor element 15. Thus, the heat generating operation of the heat generator can be quickly started when the operation of the heat generator is started.

In the afore-described first through tenth embodiments of the present invention, the depth of the angularly shifted elongate recesses functioning as a fluid outward supply means and the height of the ridges also functioning as a fluid outward supply means may be determined depending on an environmental condition and the operating condition in which the viscous fluid type heat generator is used by being incorporated in a heating system of an automobile.

FIGS. 19 through 23 illustrate an eleventh embodiment of the present invention in which a fluid shearing energizing means is provided in the heat generating chamber for increasing heat generation by the viscous fluid.

Figure 19:
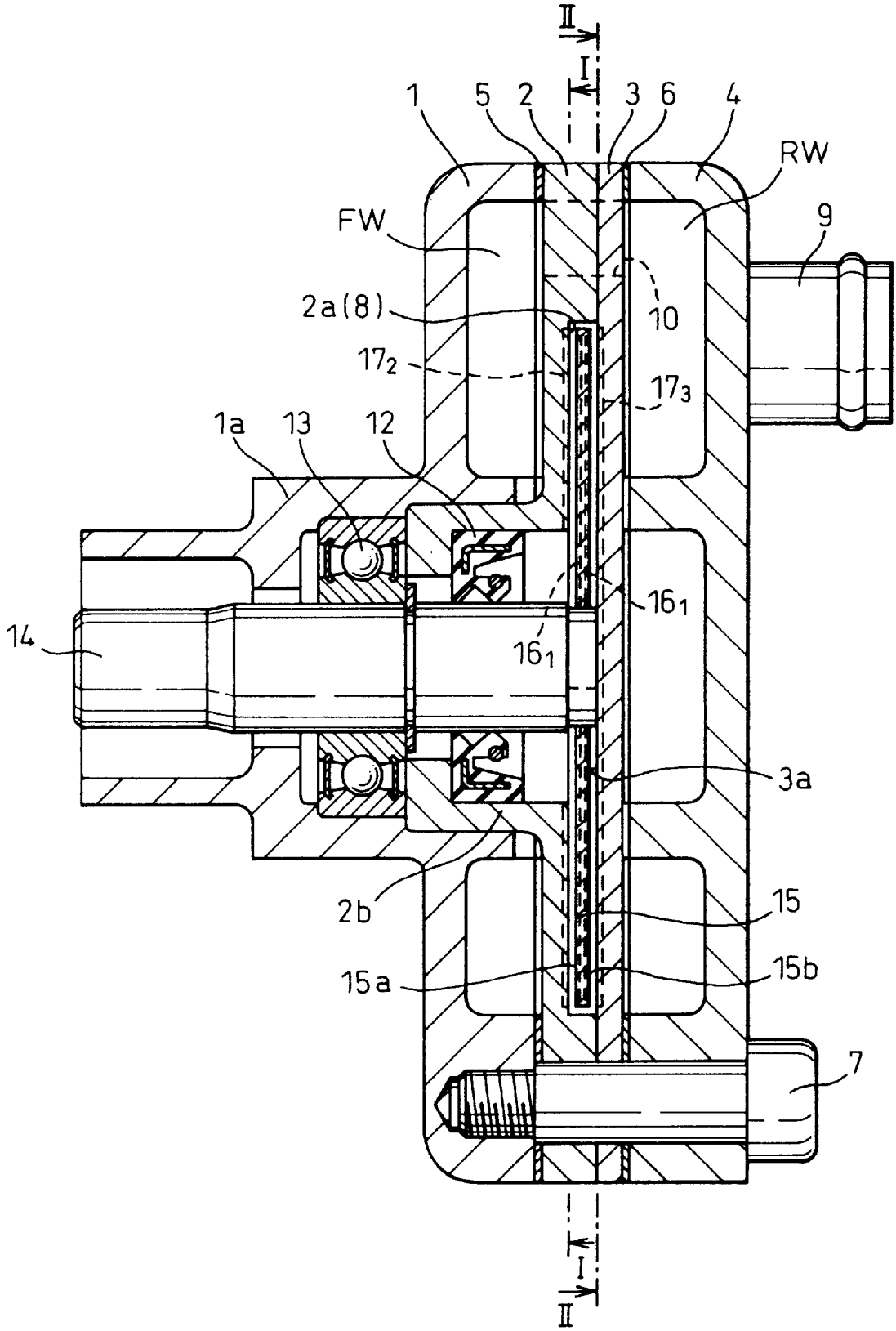
FIG. 19 is a longitudinal cross-sectional view of a viscous fluid type heat generator according to an eleventh embodiment of the present invention.

Referring to FIG. 19, a general construction of the viscous fluid type heat generator of the eleventh embodiment is similar to that of the heat generator of the first embodiment of FIG. 1, except for the constructions of a rotor element 15, and front and rear plate elements 2 and 3, as described below. Therefore, it should be understood that in FIGS. 19 through 23, the same reference numerals as those used in FIGS. 1 through 5 designate the same or like elements.

Figure 20:
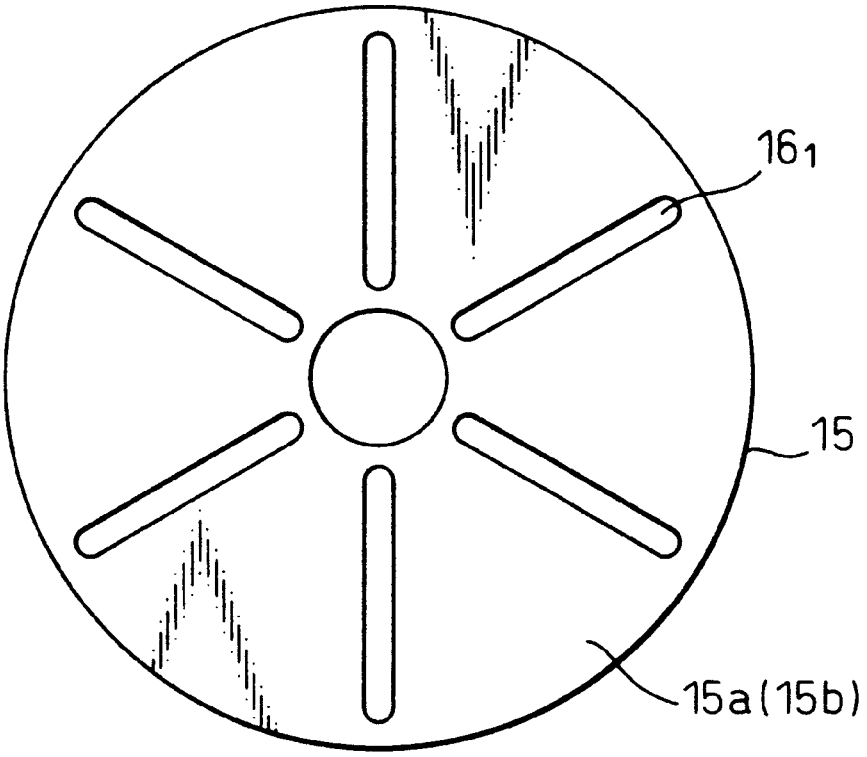
FIG. 20 is an end view of a rotor element incorporated in the heat generator of FIG. 19, illustrating a plurality of radial recesses formed in the end face of the rotor element.
Figure 21:
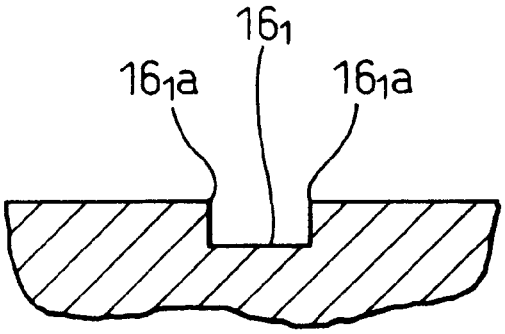
FIG. 21 is a cross-sectional view of a part of the rotor element of FIG. 20, illustrating the shape of each radial recess.

Referring to FIG. 20, the viscous fluid type heat generator of this embodiment includes a disc like rotor element 15 having opposite circular end faces 15*a* and 15*b* in which a plurality of (six) radial elongate recesses $\mathbf{16}_1$ are arranged equiangularly. Each of the recesses $\mathbf{16}_1$ has a pair of acute edges $\mathbf{16}_1a$ as shown in FIG. 21.

The heat generator also includes front and rear plate elements 2 and 3 provided with circular flat inner surfaces 2*a* and 3*a*, respectively, which define front and rear circular inner wall surfaces of a heat generating chamber 8. The front inner wall surface of the heat generating chamber 8 formed by the circular flat inner surface 2*a* of the front plate element 2 is provided with a plurality of (six) equiangularly arranged radial elongate recesses $\mathbf{17}_2$ as shown in FIG. 22.

Figure 23:
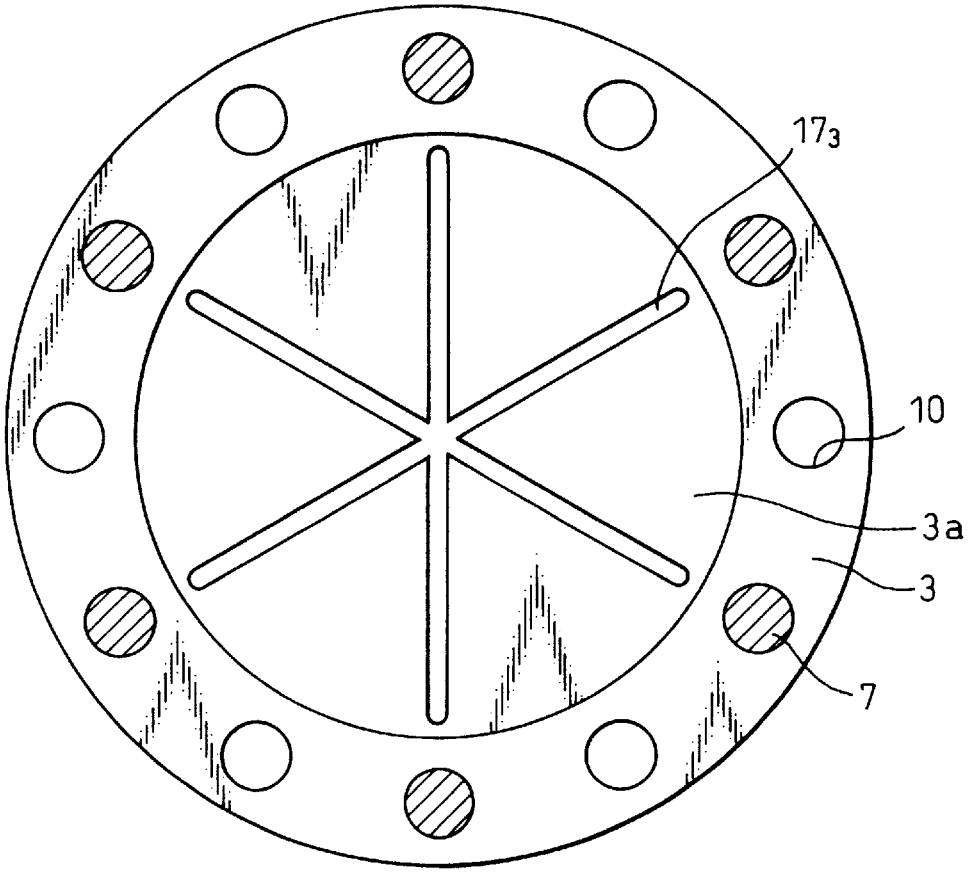
FIG. 23 is a view taken along the line II—II of FIG. 19.

The rear inner wall surface of the heat generating chamber 8 formed by the circular flat inner surface 3*a* of the rear plate element 3 is provided with a plurality of (six) equiangularly arranged radial elongate recesses $\mathbf{17}_3$ as shown in FIG. 23. Each of the radial elongate recesses $\mathbf{17}_2$ and $\mathbf{17}_3$ has a pair of acute edges similar to those of the radial elongate recess $\mathbf{16}_1$ of the rotor element 15.

Figure 22:
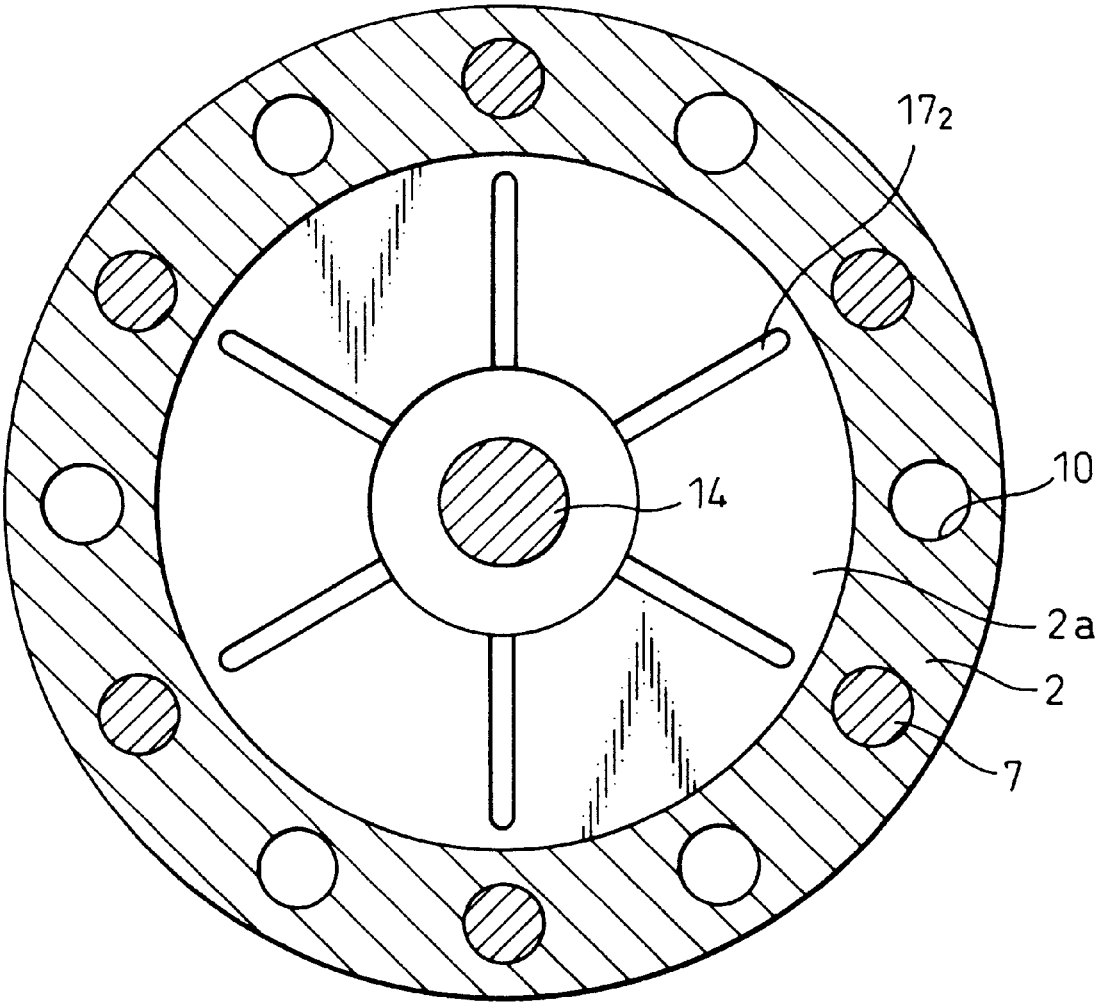
FIG. 22 is a view taken along the line I—I of FIG. 19.

It will be understood from FIG. 22, each radial elongate recess $\mathbf{17}_2$ is arranged so as to extend from a radially inner periphery of the front inner wall surface of the heat generating chamber 8 to a position adjacent to a radially outer periphery of the same front inner wall surface. Each radial elongate recess $\mathbf{17}_3$ is arranged so as to extend from a center of the rear inner wall surface of the heat generating chamber 8 to a position adjacent to a radially outer periphery of the same rear inner wall surface. Thus, the radial elongate recesses $\mathbf{17}_2$ and $\mathbf{17}_3$ of the front and rear inner wall surfaces of the heat generating chamber 8 periodically confront the radial elongate recesses $\mathbf{16}_1$ of the rotor element 15 during the rotation of the rotor element 15.

When the viscous fluid type heat generator of the embodiment of FIG. 19 is incorporated in a heating system of an automobile, and when the drive shaft 14 is driven by an automobile engine via a belt and pulley transmission mechanism, the disc like rotor element 15 is rotated within the cylindrical heat generating chamber 8. Thus, the viscous fluid, typically a silicone oil, held between the entire outer faces of the rotor element 15 and the inner wall surfaces of the heat generating chamber 8 is subjected to a shearing action by the rotation of the rotor element 15. Therefore, the silicone oil generates heat which is transmitted to a heat exchanging liquid, typically water, flowing through the front and rear heat receiving chambers FW and RW. Thus, the heat is carried to a heating circuit of the heating system to warm an objective area of the automobile such as a passenger cabin.

At this stage, a front axial space between the circular end surface 2*a* of the front plate element 2, i.e., the front inner wall surface of the heat generating chamber 8 and the end face 15*a* of the rotor element 15 is formed to be an uneven space when viewed in the rotating direction of the rotor element 15 because of the provision of the radial elongate recesses $\mathbf{17}_2$ and $\mathbf{16}_1$. Similarly, a rear axial space between the end surface 3*a* of the rear plate element 3, i.e., the rear inner wall surface of the heat generating chamber 8 and the end face 15*b* of the rotor element 15 is formed to be an uneven space when viewed in the rotating direction of the rotor element 15 because of the provision of the elongate recesses $\mathbf{17}_3$ and $\mathbf{16}_1$. Therefore, during the rotation of the rotor element 15, the viscous fluid having a chain molecular structure therein and held in the above-mentioned uneven axial front and rear spaces within the heat generating chamber 8 is subjected to a shearing action which is stronger than in the conventional case where the viscous fluid is generally held in an even space viewed in the rotating direction of the rotor element 15. Namely, when the rotor element 15 is rotating at a given speed, the radial elongate recesses $\mathbf{17}_2$, $\mathbf{17}_3$, and $\mathbf{16}_1$ of the inner wall surfaces of the heating chamber 8 and the end faces 15*a* and 15*b* of the rotor element 15 apply a restraint to the viscous fluid having the chain molecular structure, so that the viscous fluid forced to move together with the rotor element 15 is subjected to a stronger shearing action. Accordingly, the viscous fluid generates a large amount of heat due to the application of the stronger shearing action.

Further, as previously described, the radial elongate recesses $\mathbf{17}_2$, $\mathbf{17}_3$, and $\mathbf{16}_1$ can trap gaseous component contained in the viscous fluid, and the viscous fluid from which the gaseous component (gas bubbles) is removed is effectively subjected to a shearing action in the front and rear axial spaces except for the regions of these recesses $\mathbf{17}_2$, $\mathbf{17}_3$, and $\mathbf{16}_1$. This increases an amount of heat generation by the viscous fluid. Thus, the efficiency of the heat generation performed by the viscous fluid is enhanced by the viscous fluid type heat generator of the embodiment of FIGS. 19 through 23.

Further, the provision of the radial elongate recesses $\mathbf{17}_2$, $\mathbf{17}_3$, and $\mathbf{16}_1$ of the front and rear inner wall surfaces of the heat generating chamber 8 and both end faces 15*a*, 15*b* of the rotor element 15 permit the viscous fluid, i.e., the silicone fluid, to move radially from a radially inner to an outer region of the heat generating chamber 8 due to a centrifugal force applied thereto when the viscous fluid is frictionally moved by the rotating rotor element 15 in a circumferential direction. Thus, the viscous fluid is subjected to a stronger shearing action by the outer portion of the rotor element 15 having a higher circumferential speed, and accordingly, an amount of heat generation by the viscous fluid is increased compared with the conventional viscous fluid type heat generator having no radial elongate recesses $\mathbf{17}_2$, $\mathbf{17}_3$, and $\mathbf{16}_1$.

It should be understood that the circumferential width of each of the radial elongate recesses $\mathbf{17}_2$, $\mathbf{17}_3$, and $\mathbf{16}_1$ of the front and rear inner wall surfaces of the heat generating chamber 8 and the end faces of the rotor element 15 should suitably be determined. Namely, if the width of these recesses $\mathbf{17}_2$, $\mathbf{17}_3$, and $\mathbf{16}_1$ is larger than a limited value, such an effect occurs that the axial front and rear spaces between the front and rear inner wall surfaces of the heat generating chamber 8 and the end faces 15*a*, 15*b* of the rotor element 15 are substantially widened so as to lessen a shearing action applied to the viscous fluid between the front and rear axial spaces. For example, the circumferential width of the radial elongate recesses $\mathbf{16}_1$ formed in each end face 15*a* or 15*b* of the rotor element 15 should be preferably determined so that the total area of the six radial elongate recesses $\mathbf{16}_1$ is equal to or less than 20% of the entire surface area of the end face 15*a* or 15*b* of the rotor element 15.

Further, it should be appreciated that the provision of the radial elongate recesses $\mathbf{17}_2$ and $\mathbf{17}_3$ of the front and rear inner wall surfaces of the heat generating chamber 8 can promote heat transmission from the heat generating chamber 8 to the front and rear heat receiving chambers FW and RW. This is because the provision of the radial elongate recesses $\mathbf{17}_2$ and $\mathbf{17}_3$ increases a heat transmitting area provided in the heat generating chamber 8. Thus, the heat transmission from the heat generating chamber 8 to the heat receiving chambers FW and RW is enhanced to result in an increase in heat transmission efficiency of the heat generator. Therefore, the efficiency of heat generation of the viscous fluid type heat generator of the embodiment of FIGS. 19 through 23 can be high. Further, the efficient heat transmission from the heat generating chamber 8 to the heat receiving chambers FW and RW can prevent confinement of heat within the heat generating chamber 8, and therefore, thermal degradation of the viscous fluid can be suppressed, and accordingly, an operation reliability of the viscous fluid type heat generator can be increased.

It should be noted that the six radial elongate recesses $\mathbf{16}_1$ formed on each of the opposite end faces 15*a* and 15*b* of the rotor element 15 may be either in registration with or angularly shifted from one another in the rotating direction of the rotor element. When they are angularly shifted from one another, occurrence of vibration and generation of noise of the heat generator may be effectively suppressed during the operation of the viscous fluid type heat generator.

Figure 24:
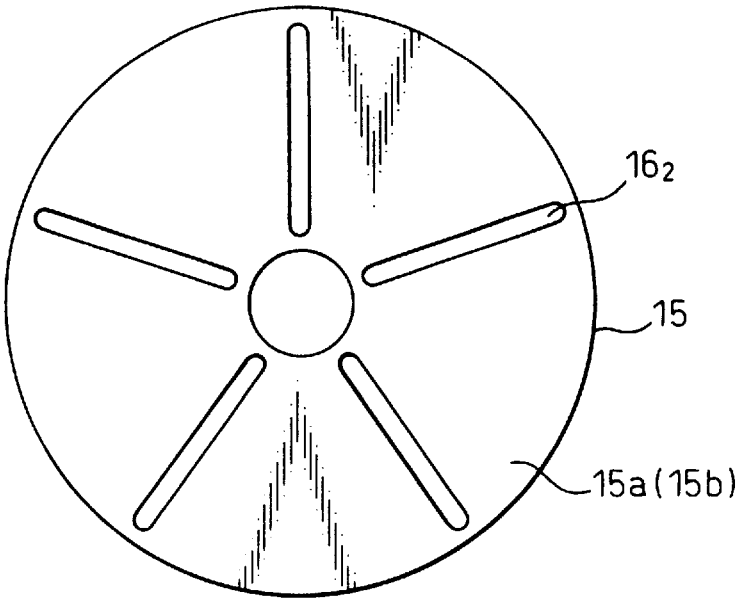
FIG. 24 is an end view of a rotor element incorporated in a viscous fluid type heat generator of a twelfth embodiment of the present invention, illustrating a plurality of radial recesses formed in the end face of the rotor element.

FIG. 24 illustrates a modified embodiment of the eleventh embodiment of FIGS. 19 through 23. Namely, in this modified embodiment, the end faces 15*a* and 15*b* of the disc like rotor element 15 is provided with five radial elongate recesses $\mathbf{16}_2$ formed therein. Namely, a smaller number of radial recesses are formed in the opposite end faces 15*a*, 15*b* of the rotor element 15 compared with the radial recesses $\mathbf{16}_1$ of the rotor element of the previous embodiment of FIG. 20. The radial recesses $\mathbf{16}_2$ of the rotor element 15 of the FIG. 24 has width, depth, and radial length equal to those of the radial elongate recesses $\mathbf{16}_1$ of the rotor element 15 of FIG. 20.

It should be understood that the other internal constructions of the viscous fluid type heat generator of the modified embodiment of FIG. 24 are similar to those of the heat generator of FIGS. 19 through 23. Therefore, in the present embodiment, the angular space between the two neighboring radial elongate recesses $\mathbf{16}_2$ of the rotor element 15 is different from (i.e., larger than) that of the two neighboring radial elongate recesses $\mathbf{17}_2$ and $\mathbf{17}_3$ of front and rear inner wall surfaces of the heat generating chamber 8. Thus, all of the radial elongate recesses $\mathbf{16}_2$ of the rotor element 15 do not simultaneously come into registration with the radial elongate recesses $\mathbf{17}_2$ and $\mathbf{17}_3$ of front and rear inner wall surfaces of the heat generating chamber 8 during the rotation of the rotor element 15. This can prevent occurrence of vibration of the heat generator during the rotation of the rotor element 15.

Of course, it should be appreciated that the viscous fluid type heat generator of the embodiment of FIG. 24 can increase an amount of heat generation due to provision of the radial elongate recesses $\mathbf{16}_2$ of the rotor element 15 and the radial elongate recesses $\mathbf{17}_2$ and $\mathbf{17}_3$ of front and rear inner wall surfaces of the heat generating chamber 8.

Figure 25:
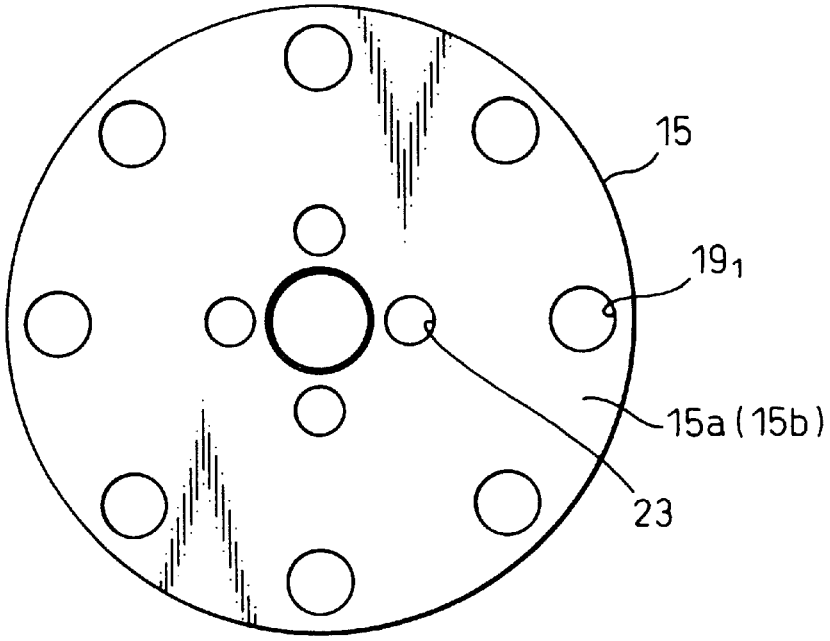
FIG. 25 is an end view of a rotor element incorporated in a viscous fluid type heat generator of a thirteenth embodiment of the present invention, illustrating a plurality of round recesses formed in the opposite end faces of the rotor element; and, FIG. 26 is a cross-sectional view of the rotor element of FIG. 25.
Figure 26:
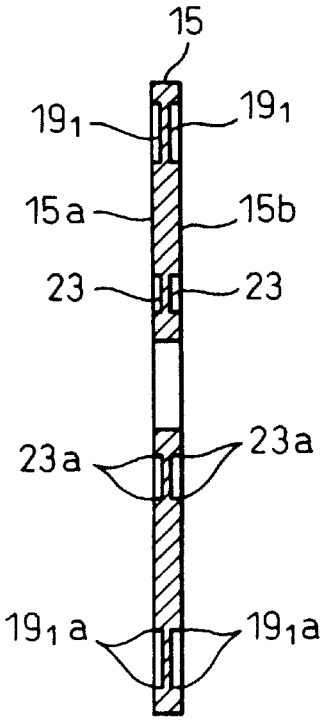

FIGS. 25 and 26 illustrate a further embodiment of the fluid shearing energizing means according to the present invention.

In the present embodiment, the disc like rotor element 15 is provided opposite circular end faces 15*a* and 15*b* in which a plurality (eight) of circular recesses $\mathbf{19}_1$ equidistantly arranged along an outer circumferential portion of respective end faces 15*a* and 15*b*, and a plurality of (four) circular recesses 23 formed in each of the end faces 15*a* and 15*b* so as to be arranged equidistantly arranged around a central bore of the rotor element 15. The diameter of each of the outside circular recesses $\mathbf{19}_1$ is formed to be larger than that of each of the inside circular recesses 23. These circular recesses $\mathbf{19}_1$ and 23 are provided with circular acute edges $\mathbf{19}_1$*a* and 23*a* as shown in FIG. 26.

These circular recesses $19_1a$ and 23*a* formed in the opposite end faces 15*a* and 15*b* of the rotor element 15 can exhibit substantially the same heat generation enhancing effect as the previous embodiments of FIGS. 1 through 23 and FIG. 24. Further, the circular recesses $19_1a$ and 23*a* can effectively trap and hold therein gaseous component contained in the viscous fluid. Thus, the shearing action applied by the rotor element 15 to the viscous fluid during the rotation of the rotor element 15 is made stronger to result in increasing an amount of heat generation by the viscous fluid.

The outside and inside circular recesses $19_1$ and 23 of the rotor element 15 may be modified so that these recesses are replaced with through-bores. Then, the viscous fluid on both sides of the rotor element 15 within the heat generating chamber 8 is permitted to pass through the through-bores and, as a result, the pressures prevailing in both sides of the rotor element 15 can be made equivalent. Then, the amount of heat generation on front side and that of heat generation on the rear side of the rotor element 15 within the heat generating chamber 8 is balanced. Therefore, excessive heating of the viscous fluid on either side of the rotor element 15 can be avoided and accordingly, the thermal durability of the viscous fluid can be long enough to increase the operation reliability of the viscous fluid type heat generator.

Further, when the rotor element 15 is axially movably mounted on, and rotatable together with the drive shaft 14, the equivalent pressures of the viscous fluid prevailing on both sides of the rotor element 15 allow the rotor element 15 to be constantly positioned at an optimum axial position within the heat generating chamber 8.

In the described embodiments of FIGS. 19 through 23, and FIG. 24, the radial elongate recesses formed in the rotor element 15 and the inner wall surfaces of the heat generating chambers 8 are provided for functioning as a fluid shearing energizing means for strengthen a shearing action applied to the viscous fluid during the rotation of the rotor element. Nevertheless, it should be understood that radial ridges formed in the rotor element 15 and the inner wall surfaces of the heat generating chambers 8 instead of the above-mentioned radial elongate recesses may equally function as a fluid shearing energizing means for strengthen a shearing action applied to the viscous fluid during the rotation of the rotor element.

From the foregoing description of the various embodiments of the present invention, it will be understood that in accordance with the present invention, the viscous fluid type heat generator can either increase or suppress an amount of heat generation by the viscous fluid in response to a change in an environmental condition where the viscous fluid type heat generator incorporated in a heating system is used, and a change in an operating condition of the heat generator such as a constantly high operating speed operating condition or a constantly low speed operating condition. Further, it will be understood that, in accordance with the present invention, the viscous fluid type heat generator can increase an operation reliability and operation life of the viscous fluid type heat generator.

Many variations and modifications will occur to a person skilled in the art without departing from the scope and spirit of the invention as claimed in the accompanying claims.

What we claim:

1. A viscous fluid type heat generator comprising;

a housing assembly defining therein, a heat generating chamber in which heat is generated, and a heat receiving chamber arranged adjacent to said heat generating chamber for permitting a heat exchanging fluid to circulate therethrough to thereby receive heat from said heat generating chamber, said heat generating chamber having inner wall surfaces thereof;

a drive shaft supported by said housing assembly to be rotatable about an axis of rotation thereof in a predetermined direction, said drive shaft being operationally connected to an external rotation-drive source;

a rotor element mounted to be rotationally driven by said drive shaft for rotation together therewith in said predetermined rotating direction within said heat generating chamber, said rotor element having outer faces confronting said inner wall surfaces of said heat generating chamber via a predetermined amount of space;

a viscous fluid, filling said space between said inner wall surfaces of said heat generating chamber of said housing assembly and said outer faces of said rotor element, for heat generation by the rotation of said rotor element; and, fluid movement regulating means arranged in said heat generating chamber to provide the viscous fluid with a regulated movement thereof from a first specified region toward a second specified region within said heat generating chamber when said rotor element is rotated by said drive shaft relative to said inner wall surfaces of said heat generating chamber.

2. A viscous fluid type heat generator according to claim 1, wherein when said first and second specified regions are radially inner and outer regions within said heat generating chamber, respectively, with respect to the axis of rotation of said rotor element, said fluid movement regulating means comprises:

a fluid outward supply means for urging the viscous fluid held in said radially inner region of said heat generating chamber to be supplied into and collected in said radially outer region of said heat generating chamber in which the viscous fluid can be subjected to a strong shearing action by a radially outer portion of said rotor element.

3. A viscous fluid type heat generator according to claim 2, wherein said fluid outward supply means comprises at least one of a ridge and an elongate recess formed in at least one of opposite outer circular end faces of said rotor element in such a manner that each of said ridge and said elongate recess is arranged to be angularly shifted or curved with respect to a radial line of said rotor element in a direction reverse to said predetermined rotating direction of said rotor element.

4. A viscous fluid type heat generator according to claim 3, wherein said ridge or said elongate recess formed in at least one of said opposite outer circular end faces of said rotor element has an end thereof terminating at a position adjacent to an outer peripheral portion of said rotor element.

5. A viscous fluid type heat generator according to claim 3, wherein said elongate recess formed in at least one of said opposite outer circular end faces of said rotor element includes a bottom thereof having a maximum depth bottom portion formed at least at a portion of said bottom, said maximum depth bottom portion having a predetermined amount of depth larger than an amount of said space between each of said inner wall surfaces of said heat generating chamber of said housing assembly and one of said outer circular end faces of said rotor element.

6. A viscous fluid type heat generator according to claim 3, wherein said elongate recess formed in at least one of said opposite outer circular end faces of said rotor element includes a bottom thereof having at least one ascending portion thereof formed to gradually ascend toward an end of said elongate recess terminating at a position adjacent to an outer peripheral portion of said rotor element.

7. A viscous fluid type heat generator according to claim 3, wherein said at least one of said ridge and said elongate recess formed in at least one of said opposite outer circular end faces of said rotor element is provided with a pair of acute edges formed therein.

8. A viscous fluid type heat generator according to claim 3, wherein said at least one of said ridge and said elongate recess formed in at least one of said front and rear inner wall surfaces of said heat generating chamber is provided with a pair of acute edges formed therein.

9. A viscous fluid type heat generator according to claim 2, wherein said fluid outward supply means comprises at least one of a ridge and an elongate recess formed in at least one of front and rear inner circular wall surface portions of said inner wall surfaces of said heat generating chamber, said one of said ridge and said elongate recess of said front or rear inner circular wall surface portion of said heat generating chamber being formed in such a manner that each of said ridge and said elongate recess is arranged to be angularly shifted or curved with respect to a radial line of said inner circular wall surface portion of said heat generating chamber in a direction the same as said predetermined rotating direction of said rotor element.

10. A viscous fluid type heat generator according to claim 9, wherein each of said ridge and said elongate recess formed in at least one of said inner circular wall surface portions of said heat generating chamber has the shape of either a spirally extending ridge or a spirally extending recess.

11. A viscous fluid type heat generator according to claim 9, wherein said elongate recess formed in at least one of said inner circular wall surface portions of said heat generating chamber includes a bottom thereof having a maximum depth bottom portion formed at least at a portion of said bottom, said maximum depth bottom portion having a predetermined amount of depth larger than an amount of said space between each of said inner wall surfaces of said heat generating chamber of said housing assembly and one of said outer circular end faces of said rotor element.

12. A viscous fluid type heat generator according to claim 9, wherein said elongate recess formed in at least one of said inner circular wall surface portions of said heat generating chamber includes a bottom thereof having at least one ascending portion thereof formed to gradually ascend toward an outer end of said elongate recess terminating at a position adjacent to an outer peripheral portion of said inner circular wall surface portion of said heat generating chamber.

13. A viscous fluid type heat generator according to claim 9, wherein an angle "θ" of shifting of said each of said ridge and said elongate recess with respect to the radial line of inner circular wall surface portion of said heat generating chamber is determined so that the angle "θ" is larger than 0 degree but smaller than 45 degrees.

14. A viscous fluid type heat generator according to claim 2, wherein at least one of said inner wall surfaces of said heat generating chamber is provided with a circular wall surface portion thereof provided with a plurality of radial elongate recesses formed therein.

15. A viscous fluid type heat generator according to claim 2, wherein said outer faces of said rotor element is provided with opposite circular end faces, one of said circular end faces being provided with a plurality of radial elongate recesses formed therein.

16. A viscous fluid type heat generator according to claim 1, wherein when said first and second specified regions are radially outer and inner regions within said heat generating chamber, respectively, with respect to the axis of rotation of said rotor element, said fluid movement regulating means comprises a fluid inward supply means for urging the viscous fluid held in said radially outer region of said heat generating chamber to be supplied into and collected in said radially inner region of said heat generating chamber where the viscous fluid is subjected to a less strong shearing action by a radially inner portion of said rotor element during the rotation thereof.

17. A viscous fluid type heat generator according to claim 16, wherein said fluid inward supply means comprises at least one of a ridge and an elongate recess formed in at least one of opposite outer circular end faces of said rotor element in such a manner that each of said ridge and elongate recess is arranged to be angularly shifted or curved with respect to a radial line of said outer circular end face of said rotor element in a direction the same as said predetermined rotating direction of said rotor element.

18. A viscous fluid type heat generator according to claim 17, wherein said elongate recess formed in at least one of said opposite outer circular end faces of said rotor element includes a bottom thereof having a maximum depth bottom portion formed at least at a portion of said bottom, said maximum depth bottom portion having a predetermined amount of depth larger than an amount of said space between each of said inner wall surfaces of said heat generating chamber of said housing assembly and one of said outer circular end faces of said rotor element.

19. A viscous fluid type heat generator according to claim 17, wherein said elongate recess formed in at least one of said opposite outer circular end faces of said rotor element includes a bottom thereof having at least one ascending portion thereof formed to gradually ascend toward an end of said elongate recess terminating at a position adjacent to an outer peripheral portion of said rotor element.

20. A viscous fluid type heat generator according to claim 16, wherein said fluid inward supply means comprises at least one of a ridge and an elongate recess formed in at least one front and rear inner circular wall surface portions of said inner wall surfaces of said heat generating chamber, said one of said ridge and said elongate recess of said front or rear inner circular wall surface portion of said heat generating chamber being formed in such a manner that each of said ridge and said elongate recess is arranged to be angularly shifted or curved with respect to a radial line of said inner circular wall surface portion of said heat generating chamber in a direction reverse to said predetermined rotating direction of said rotor element.

21. A viscous fluid type heat generator according to claim 20, wherein each of said ridge and said elongate recess formed in at least one of said inner circular wall surface portions of said heat generating chamber has the shape of either a spirally extending ridge or a spirally extending recess.

22. A viscous fluid type heat generator according to claim 20, wherein each of said ridge and said elongate recess formed in at least one of said circular end faces of said rotor element has the shape of either a spirally extending ridge or a spirally extending recess.

23. A viscous fluid type heat generator according to claim 20, wherein said elongate recess formed in at least one of said front and rear inner circular wall surface portions of said inner wall surfaces of said heat generating chamber includes a bottom thereof having a maximum depth bottom portion formed at least at a portion of said bottom, said maximum depth bottom portion having a predetermined amount of depth larger than an amount of said space between each of said inner wall surfaces of said heat generating chamber of said housing assembly and one of said outer circular end faces of said rotor element.

24. A viscous fluid type heat generator according to claim 20, wherein said elongate recess formed in at least one of said front and rear inner circular wall surface portions of said inner wall surfaces of said heat generating chamber includes a bottom thereof having at least one ascending portion thereof formed to gradually ascend toward an inner end of said elongate recess terminating at a position adjacent to an inner peripheral portion of said inner circular wall surface portion of said heat generating chamber.

25. A viscous fluid type heat generator according to claim 16, wherein at least one of said inner wall surfaces of said heat generating chamber is provided with a circular wall surface portion thereof provided with a plurality of radial elongate recesses formed therein.

26. A viscous fluid type heat generator according to claim 1, wherein said housing assembly further defines a fluid storing chamber fluidly communicating with said heat generating chamber by a fluid supplying passageway and a fluid withdrawing passageway, said fluid storing chamber having a capacity thereof sufficient for storing a given volume of the viscous fluid which is larger than the capacity of the space between said inner wall surfaces of said heat generating chamber and said outer faces of said rotor element.

27. A viscous fluid type heat generator comprising: a housing assembly defining therein, a heat generating chamber in which heat is generated, and a heat receiving chamber arranged adjacent to the heat generating chamber for permitting a heat exchanging fluid to circulate therethrough to thereby receive heat from said heat generating chamber, said heat generating chamber having inner wall surfaces thereof;

a drive shaft supported by said housing assembly to be rotatable about an axis of rotation thereof in a predetermined direction, said drive shaft being operationally connected to an external rotation-drive source;

a rotor element mounted to be rotationally driven by said drive shaft for rotation together therewith in said predetermined rotating direction within said heat generating chamber, said rotor element having outer faces confronting said inner wall surfaces of said heat generating chamber via a predetermined amount of space;

a viscous fluid, filling said space between said inner wall surfaces of said heat generating chamber of said housing assembly and said outer faces of said rotor element, for heat generation by the rotation of said rotor element; and, fluid shearing energizing means arranged in said heat generating chamber to strengthen a shearing action applied to the viscous fluid held in the space between said inner wall surfaces of said heat generating chamber of said housing assembly and said outer faces of said rotor element when said rotor element is rotated by said drive shaft relative to said inner wall faces of said heat generating chamber whereby an amount of generation of heat is increased during the rotation of said rotor element.

28. A viscous fluid type heat generator according to claim 27, wherein said fluid shearing energizing means comprises one of a ridge means and an elongate recess means formed in at least one of said outer faces of said rotor element and said inner wall surfaces of said heat generating chamber, said one of said ridge means and said elongate recess means being arranged to change an extent of said space in a circumferential direction with respect to the axis of rotation of said rotor element whereby the viscous fluid having a chain molecular structure is subjected to a restraint against movement of the viscous fluid in a circumferential direction caused the rotation of said rotor element.

29. A viscous fluid type heat generator according to claim 27, wherein said one of said ridge means and said elongate recess means formed in at least one of said outer faces of said rotor element and said inner wall surfaces of said heat generating chamber comprises a plurality of radial ridges or a plurality of radial elongate recesses.

30. A viscous fluid type heat generator according to claim 29, wherein one of said plurality of radial ridges and said plurality of radial elongate recesses are formed in at least one of the opposite outer end faces of said rotor element, and formed to confront one of said plurality of radial ridges and said plurality of radial elongate recesses formed in one of front and rear circular inner wall surface portions of said inner wall surfaces of said heat generating chamber during the rotation of said rotor element.

31. A viscous fluid type heat generator according to claim 30, wherein said one of said plurality of radial ridges and said plurality of radial elongate recesses formed in at least one of opposite outer end faces of said rotor element are arranged equiangularly, and wherein said one of said plurality of radial elongate recesses formed in one of said front and rear circular inner wall surface portions of said inner wall surfaces of said heat generating chamber are arranged equiangularly.

32. A viscous fluid type heat generator according to claim 31, wherein an angular space between two neighboring said radial ridges or between two neighboring said radial elongate recesses formed in at least one of opposite outer end faces of said rotor element is different from an angular space between two neighboring said radial ridges or between two neighboring said radial elongate recesses formed in at least one of front and rear circular inner wall surface portions of said inner wall surfaces of said heat generating chamber.

33. A viscous fluid type heat generator according to claim 30, wherein said one of said plurality of radial ridges and said plurality of radial elongate recesses are formed in both of said opposite outer end faces of said rotor element, said one of said plurality of radial ridges and said plurality of radial elongate recesses formed in one of said opposite outer end faces of said rotor element are angularly shifted with respect to said one of said plurality of radial ridges and said plurality of radial elongate recesses formed in the other of said opposite outer end faces of said rotor element.

34. A viscous fluid type heat generator according to claim 29, wherein said one of said ridge means and said elongate recess means formed in at least one of said outer faces of said rotor element and said inner wall surfaces of said heat generating chamber are provided with acute edges, respectively.

* * * * *